US009579240B2

(12) United States Patent
Krolick et al.

(10) Patent No.: US 9,579,240 B2
(45) Date of Patent: Feb. 28, 2017

(54) EMERGENCY LIFT AND TRANSPORT CHAIR

(71) Applicants: Robert S Krolick, Roseville, CA (US); Sanford Shapiro, San Rafael, CA (US); Duane Carling, Farmington, UT (US)

(72) Inventors: Robert S Krolick, Roseville, CA (US); Sanford Shapiro, San Rafael, CA (US); Duane Carling, Farmington, UT (US)

( * ) Notice: Subject to any disclaimer, the term of this patent is extended or adjusted under 35 U.S.C. 154(b) by 64 days.

(21) Appl. No.: 14/741,299

(22) Filed: Jun. 16, 2015

(65) Prior Publication Data

US 2016/0367414 A1 Dec. 22, 2016

(51) Int. Cl.
*A61G 1/017* (2006.01)

(52) U.S. Cl.
CPC ..... *A61G 1/017* (2013.01)

(58) Field of Classification Search
CPC ..... A47C 1/03216; A47C 1/03233; A47C 1/1035; A47C 1/0355; A47C 4/04; A47C 17/17; A47C 17/175; A47C 17/1756; A47C 20/046; A47C 20/048; A47C 20/12; A47C 20/16; A61G 1/017; A61G 5/006; A61G 7/015; A61G 7/018; A61G 13/08; B60N 2/2213
See application file for complete search history.

(56) References Cited

U.S. PATENT DOCUMENTS

| | | | | |
|---|---|---|---|---|
| 2,202,383 | A | 12/1937 | Hymer et al. | |
| 3,122,758 | A * | 3/1964 | Ferneau | A61G 1/017 297/1 |
| 4,987,620 | A | 1/1991 | Sharon | |
| 6,336,235 | B1 | 1/2002 | Ruehl | |
| 6,381,781 | B1 | 5/2002 | Bourgraf et al. | |
| 6,389,623 | B1 | 5/2002 | Flynn et al. | |
| 6,799,770 | B2 | 10/2004 | Patrick et al. | |

FOREIGN PATENT DOCUMENTS

| | | | | |
|---|---|---|---|---|
| DE | 2349264 A1 * | 4/1975 | | A47C 4/04 |
| WO | WO 2012169871 A1 * | 12/2012 | | A47C 23/34 |

* cited by examiner

*Primary Examiner* — Nicholas Polito
(74) *Attorney, Agent, or Firm* — Steven A. Nielsen; www.NielsenPatents.com

(57) ABSTRACT

A mechanical lift features the low profile of a traditional wood and cloth cot stretcher allowing patients to be easily rolled or moved upon a flat surface. An integrated mechanical lift system then lifts a patient to a raised or seated position without need for manual lifting. The lift allows patients to be moved and transported without back strain to health care workers or first responders. The lift may be raised by the mechanical movement or expansion of a piston. A seat plate 420 may rest upon a non-tilting seat strut 310 and become a seat as the lift rises. During the lifting process, a back plate 400, attached to a back strut 205 gently rises to place the patient in a seated position as a leg plate 440 lowers.

18 Claims, 37 Drawing Sheets

EMERGENCY LIFT AND TRANSPORT CHAIR

BACKGROUND OF THE INVENTION (1) Field of the Invention

The invention generally relates to low profile stretchers that rise to a seated position or horizontal position. More particularly, the invention relates to the use of unique rotational and sliding components that are inwardly layered to create a low profile lift that moves a patient from the floor to an upward position with a single powered movement.

(2) Description of the Related Art

In the related art, health care workers and first responders face the dilemma of moving a patient from the ground to a raised position. Such workers often suffer significant injuries in manually lifting a patient off of the ground. A traditional folding cot stretcher having a wood frame and cloth body provides a low profile platform wherein a patient may be rolled or slid upon the cloth body or patient surface. The wood and cloth stretcher is then lifted off of the ground by workers. While sliding or rolling a patient upon a low profile prior art cot stretcher presents a minimal risk of injury, manually lifting the stretcher presents a significant risk of injury.

In the related art, stretchers with mechanical means of lift are known, but present a raised profile, inviting injury to workers lifting a patient upon the raised platform. For example, U.S. Pat. No. 6,389,623 issued on May 21, 2002 to Flynn et al presents a modern iteration of the classical ambulance stretcher and discloses a flat stretcher near the ground and provides a scissor type frame to lift the stretcher off of the ground. FIG. 12 of Flynn presents a profile view of the stretcher in its lowest position and shows several components, vertically configured, between the patient surface and the ground. The existence of components between the patient surface and the ground represents a vertical distance requiring the manual lifting of a patient.

European patent application 90830259.9, publication No. EP 0 406 178 A2 by Corradi discloses a wheeled stretcher used to move a patient from a bed to a stretcher and vice versa. The Corradi stretcher relies upon a standing frame to keep the structure at a bed level and is not designed to lift a patient from the ground. While the Corradi stretcher will move a patient from bed to bed, Corradi fails to lift a patient from the ground.

The related art fails to disclose or suggest means or methods of providing a stretcher having a patient surface at near ground level and means of mechanically lifting the patient to a raised position, either seated or horizontal. Health care workers currently injure themselves lifting up low tech wood and cloth stretchers or from lifting patients upon the raised platforms of prior art mechanical lifts. Thus, there are significant shortfalls in the art.

BRIEF SUMMARY OF THE INVENTION

The present invention overcomes shortfalls in the related art by presenting an unobvious and unique combination, configuration and use of components to present a low profile stretcher having mechanical means of lifting a patient to either a seated or horizontal position. Disclosed embodiments overcome shortfalls in the art by providing a unique set of components that are horizontally layered so as to present an initial low profile from the ground and efficient means of mechanical lift. The presently disclosed embodiments provide the low profile of a wood and cloth cot stretcher but with mechanical means of lifting a patient, thus greatly reducing the risk of injury to health care workers.

Disclosed embodiments overcome shortfalls in the art with an efficient configuration of an integrated piston design. Mechanical lift may be achieved by use of one or two integrated pistons that may be powered by any means such as hydraulics, hand or foot pumps, $CO_2$ cartridges, pulleys and hand cranks. The integrated piston system achieves a low profile and mechanical efficiency by attachment to an upper cross bar and attachment to a lower cross bar, with the lower cross bar moving within a track or void of a wheelie bar, with the lower cross bar further penetrating the wheelie bar and moving a wedge bar. The wedge bar may be retained to the inside of a back strut, with the back strut attached to a wedge. Starting in a flat position, as the piston is moved, the lower cross bar moves within a wheelie bar and moves the wedge bar into the wedge, causing an initial lifting movement.

The initial movement of the wedge bar into the wedge starts the initial movement of the wheelie bar. The longitudinal void of the wheelie bar not only retains the powered lower cross bar but also assists in transferring movement of the piston to angular movement of the wheelie bar. The two wheelie bars may be rigidly attached to either side of a wheelie gear component. The wheelie gear may comprise gear teeth meshed with gear teeth of a back gear component. The back gear may be rigidly attached to a back strut. The back strut may support a back plate and be hingedly connected to an upper cross bar and bottom strut.

The gear teeth of the wheelie gear and the gear teeth of the back gear may be adjacent to or pivot near or upon a hinge plate. The hinge plate may comprise side retainer brackets attached to seat struts. The seat struts may support a seat plate and may be hingedly attached to a front struts. The front struts may support a leg plate and may be hingedly attached to bottom struts.

Prior art shortfalls in patient comfort and safety are overcome by the rigid attachment of the seat struts to the hinge plate and the rotation of other parts near the hinge plate, as the hinge plate and attached seat plate remain horizontal during the lifting movement. Thus, a patient is not strained or moved off balance during a lift and the potential for pinched fingers or limbs is minimized as component rotation occurs just behind the patient.

Prior art shortfalls are overcome and patient safety is enhanced by the concurrent movement of the back struts in relation to the movement of the wheelie bars. The concurrent movements raise the back struts and attached back plate so as to support a patient in a smoothly flowing back lift motion that prevents the patent from falling forward. The connection points and related geometry of the front struts move the front plate at a slow relative rate and without tilt so as to further prevent forward falling or patient discomfort.

These and other advantages over the prior art will become even more apparent after consideration of the drawings and more detailed description.

REFERENCE NUMERALS IN THE DRAWINGS

Figure 1:
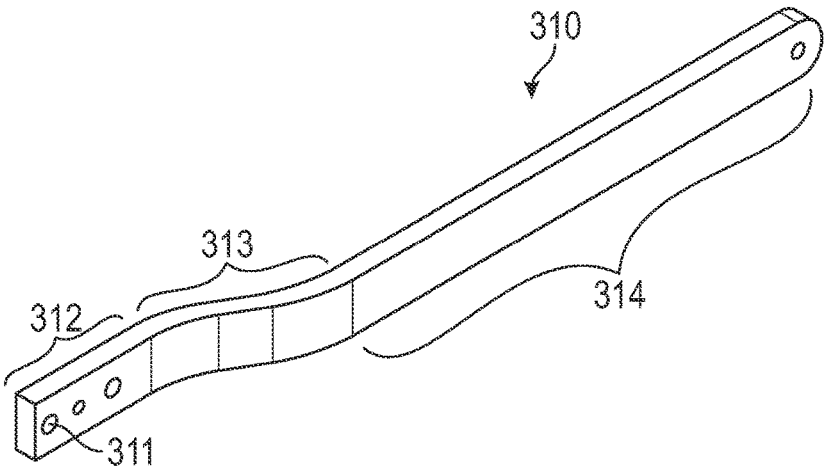
FIG. 1 is a perspective view of a seat strut

100 lift chair in general
200 lift assembly
205 back strut
206 voids in back strut, may be used to retain back gear
207 back end of back strut 205 may be near the piston 260 or upper cross bar 210
208 voids in back strut, may be used to retain wedge 280
209 bottom end of back strut 205, may be near or attached to the bottom strut 330
210 cylinder rod cross head—upper cross bar, may be of same construction as cross bar or lower cross bar 275
214 pivot void of back gear 215, may retain pivot pin shared with hinge plate 230
215 back gear, attached to either back strut 205
216 back gear void, used to attachment with back strut 205
217 body of back gear 215
218 gear teeth of back gear 215
219 pivot head of back gear 215
220 wheelie gear
221 cross bar of wheelie gear 220
224 side bar of wheelie gear 220
225 voids of side bar 224 of wheelie gear 220
227 gear teeth of wheelie gear
228 pivot head of wheelie gear 220
229 pivot void of wheelie gear 220, may be used to retain pivot pin shared with hinge plate 230
230 hinge plate
232 side retainer bracket of hinge plate 230
234 horizontal bar of hinge plate
235 fastener void of side retainer bracket, used to fasten to seat strut 310
237 void of side retainer bracket, may be used to retain pivot pin with wheelie gear
238 void of side retainer bracket, may be used to retain pivot pin with back gear 215
240 wheelie bar
241 longitudinal void of wheelie bar 240, main retain cross bar 275
243 attachment voids in wheelie bar 240, may be used to retain wheelie gear 220
245 body or longitudinal body of wheelie bar 240
246 latch of wheelie bar 240
247 starting wedge of wheelie bar 240
250 lower cross head
260 cylinder
265 piston
266 extra notch in cylinder rod clevis 267
267 cylinder rod clevis
268 hydraulic system, comprising a piston 265 and cylinder 260
270 wedge bar
271 cambered edge of wedge bar 270 used with angled edge 281 of wedge 280
272 indent area of wedge bar, used to retain wedge washer
273 void of wedge bar
274 longitudinal body of wedge bar 270
275 cross bar or lower cross bar
276 washer nipple of cross bar, used to retain washer 277
277 washer of cross bar 275
278 main longitudinal section of cross bar 275
279 retention area of cross bar 275, may be used to retain a cylinder rod clevis 267
280 wedge
281 angled edge of wedge 280, interfaces with cambered edge 271 of wedge bar 270
300 front assembly
310 seat strut

311 voids seat strut 310, may be used to retain fasteners with hinge plate 230

312 attachment area, may be used to fasten with hinge plate

314 seat plate support area, may be used to support seat plate 420

313 curved section of seat strut

320 front strut

321 void within longitudinal body 323 of front strut 320

323 longitudinal body of front strut 320

324 longitudinal void defined within longitudinal body 323 of front strut 320

330 bottom strut

400 back plate

420 seat plate

440 leg plate

500 hydraulic tubing

These and other aspects of the present invention will become apparent upon reading the following detailed description in conjunction with the associated drawings.

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

Referring to FIG. 1, a perspective view of a seat strut 310 is shown with a seat plate support area 314 attached or contiguous to a curved section 313, the curved section attached to or contiguous to an attachment area 312 and the attachment area defining one or more voids 311 or retention voids. The voids 311 of the seat strut may be used to fasten the seat strut to a hinge plate 230. The seat plate support area may support or be attached to a seat plate 420.

Figure 2:
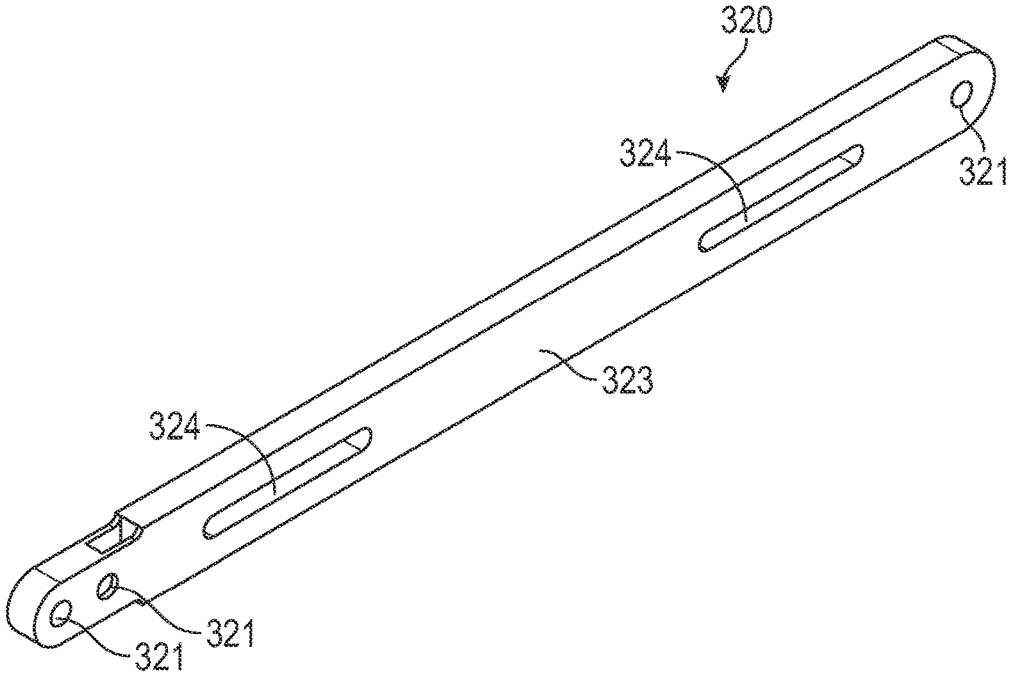
FIG. 2 is a perspective view of a front strut

Referring to FIG. 2, a perspective view of a front strut 320 is shown with longitudinal body 323 with voids 321 and longitudinal voids 324 defined within the longitudinal body 323. A front strut may be attached to a seat strut 310 and a bottom strut 330.

Figure 3:
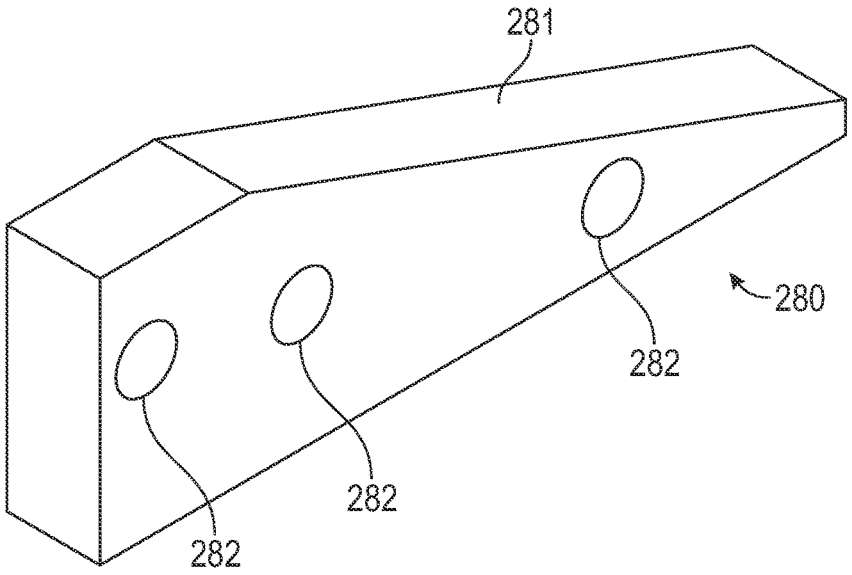
FIG. 3 is a perspective view of a wedge

FIG. 3 depicts a perspective view of a wedge 280, the wedge comprising a angled edge 281 or angled plane. The wedge 280 may define a plurality of attachment voids 282 to assist in attachment of the wedge 280 to a back strut 205. The angled edge 281 may slide upon a cambered edge 271 of a wedge bar 270.

Figure 4:
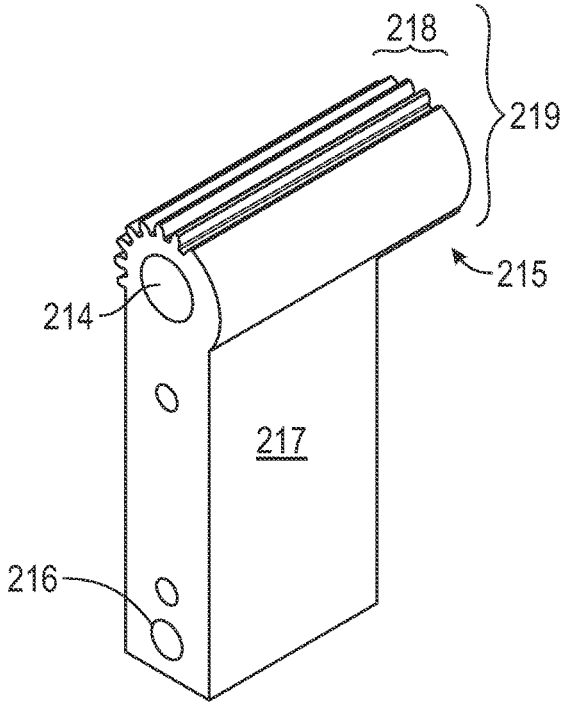
FIG. 4 is a perspective view of a back gear

FIG. 4 depicts a perspective view of back gear 215 comprising a body 217 attached to or contiguous to a pivot head 219. A pivot head 219 may comprise a plurality of gear teeth 218 and may define a pivot void 214. A back gear may define one or more attachment voids 216 which may be used to attach the back gear to a back strut 205. A back gear 215 may be rigidly attached to back strut 205. The gear teeth 218 of a back gear may mesh with or comport to gear teeth 227 of a wheelie gear 220.

Figure 5:
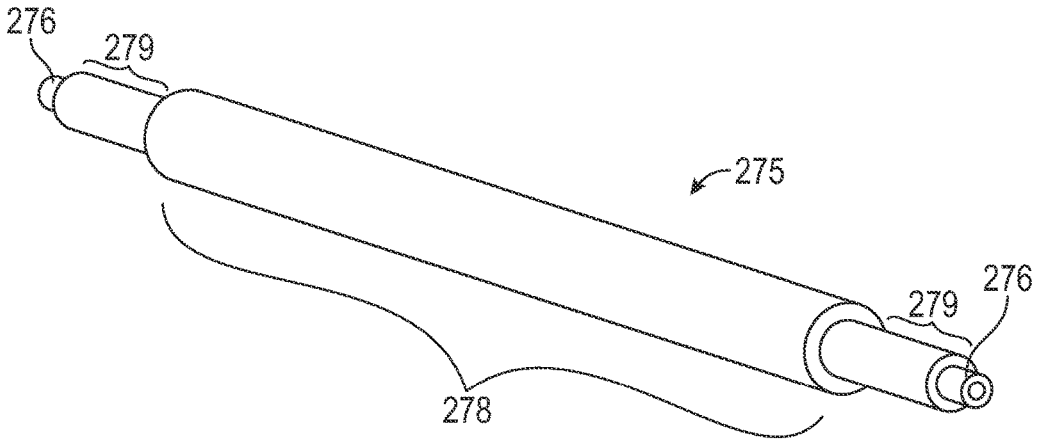
FIG. 5 is a perspective view of a cross bar

FIG. 5 depicts a perspective view of a cross bar 275 which may comprise a main longitudinal section 278 attached to or contiguous with retention areas 279 and more distal washer nipples 276. The washer nipples 276 may be used to retain washers 277 within indent areas 272 of a wedge bar 270. A cross bar may be an upper cross bar or a lower cross bar.

Figure 6:
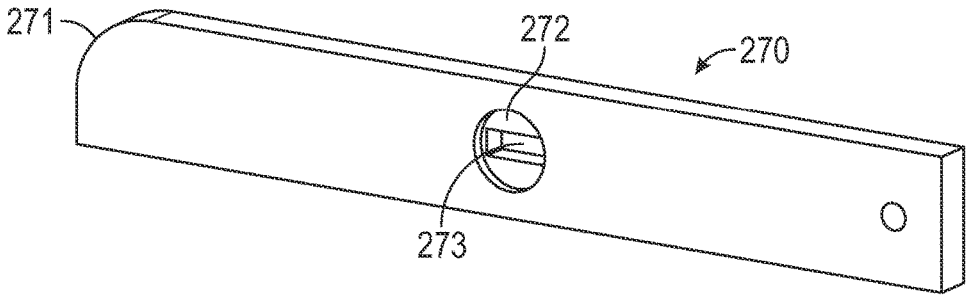
FIG. 6 is a perspective view of a wedge bar

FIG. 6 depicts a perspective view of a wedge bar 270. The term "wedge bar" as used herein refers to a mechanical member comprising a longitudinal body 274, a cambered edge 271, an indent area 272 and a void 273. The void 273 may accept a washer nipple 276 of a cross bar 275.

Figure 7:
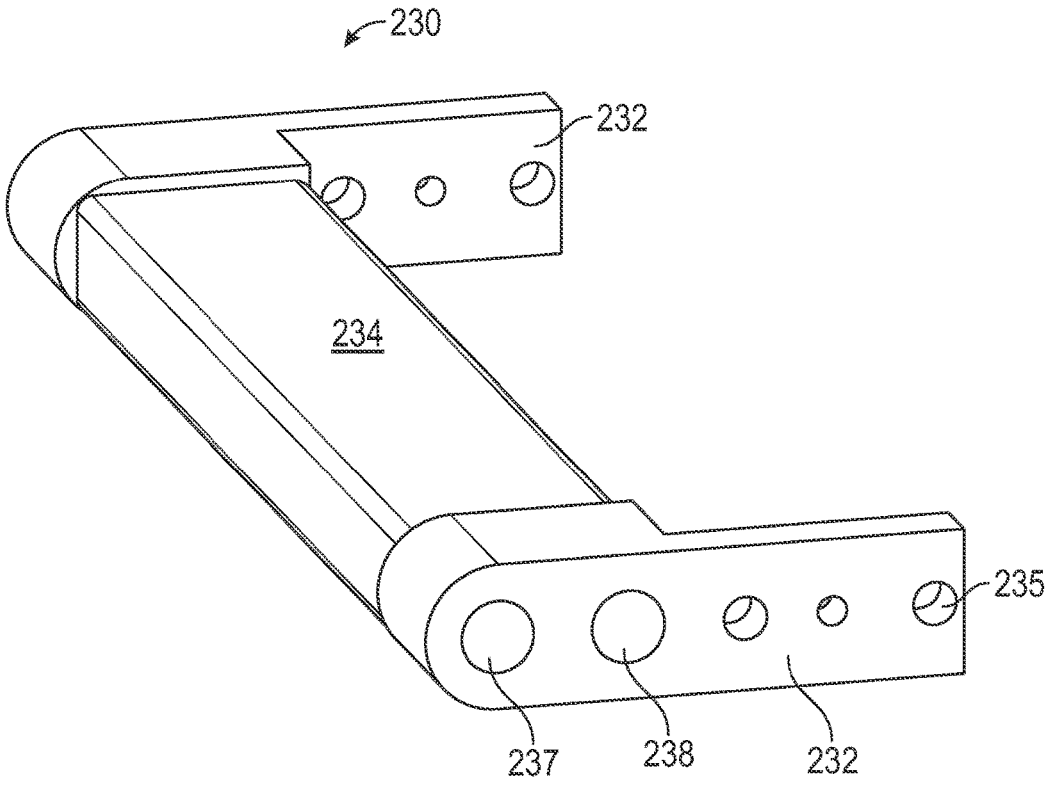
FIG. 7 is a perspective view of a hinge plate

FIG. 7 depicts a perspective view of a hinge plate 230 that may comprise a horizontal bar 234 or longitudinal body and a pair of side retainer brackets 232. Each side retainer bracket 232 may comprise or define a plurality of voids, such voids may comprise a first void 237 that could be used to retain a pivot pin or other implement in conjunction with a wheelie gear 220, a second void 238 that could be used to retain a pivot pin or other implement in conjunction with a back gear 215 and one or more fastener voids 235 that may be used to fasten the hinge plate to a seat strut 310.

Figure 8:
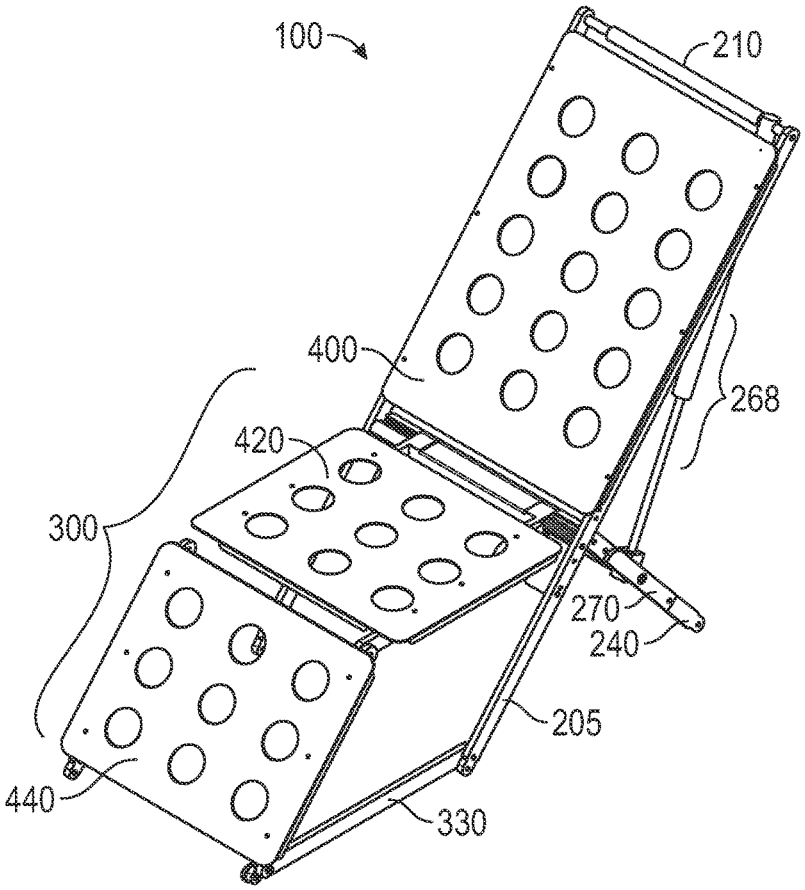
FIG. 8 is a perspective view of a disclosed lift chair

FIG. 8 depicts a perspective view of a lift chair 100 which may comprise a front assembly which may comprise a seat plate 420, leg plate 440 and bottom strut 330. A lift chair may further comprise a back plate 400 attached to one or more back struts 205 and one or more wheelie bars 240

Figure 9:
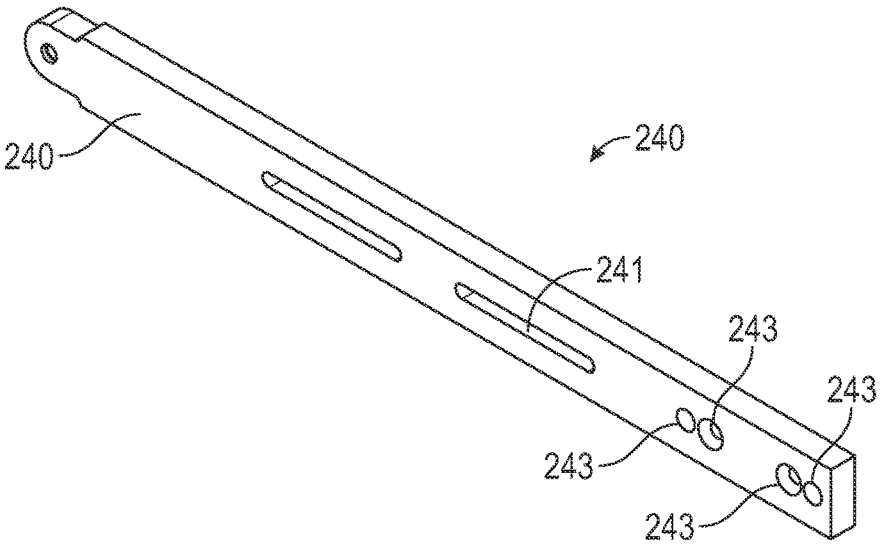
FIG. 9 is a perspective view of a wheelie bar

FIG. 9 depicts a wheelie bar 240. The term "wheelie bar" as used herein refers to a mechanical member comprising a body 240 or longitudinal body 240 defining one or more longitudinal voids 243 and attachment voids 243. The attachment voids 243 may be used to fasten the wheelie bar 240 to a wheelie gear 220. A longitudinal void 241 may be used to accept or retain a cross bar 275.

Figure 10:
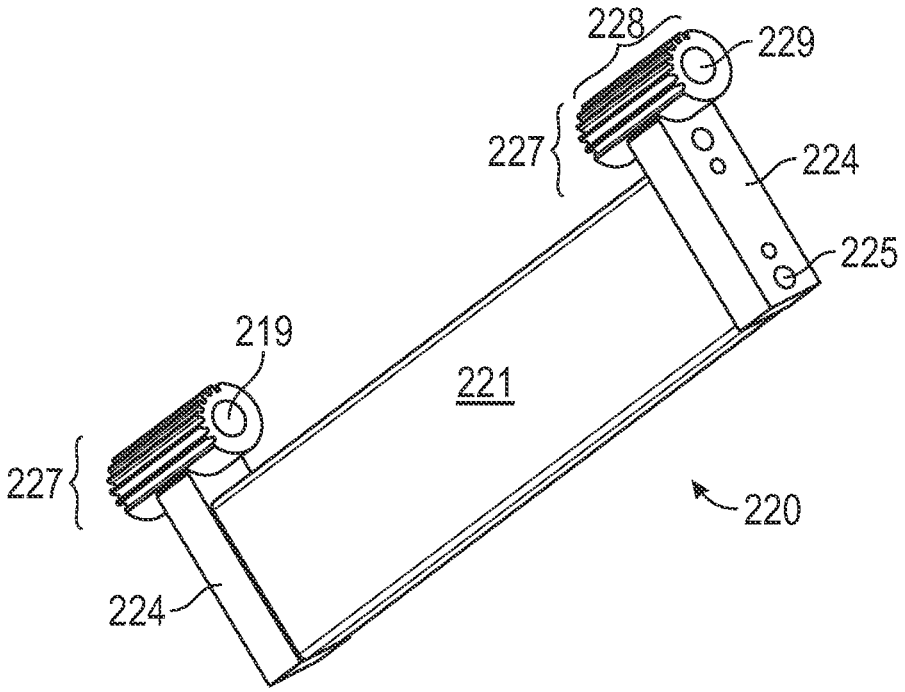
FIG. 10 is a perspective view of a wheelie gear

FIG. 10 depicts a perspective view of a wheelie gear 220. The term "wheelie gear" as used herein refers to a body comprising a cross bar 221 attached to one or more side bars 224. Each side bar is attached to or contiguous with a pivot head 228 and a pivot head 228 may comprise a plurality of gear teeth 227 and define a pivot void 229. The wheelie gear pivot void 229 may be used to retain a pivot pin shared with a hinge plate 230. The wheelie bar side bar 224 may define one or more attachment voids 225.

Figure 11:
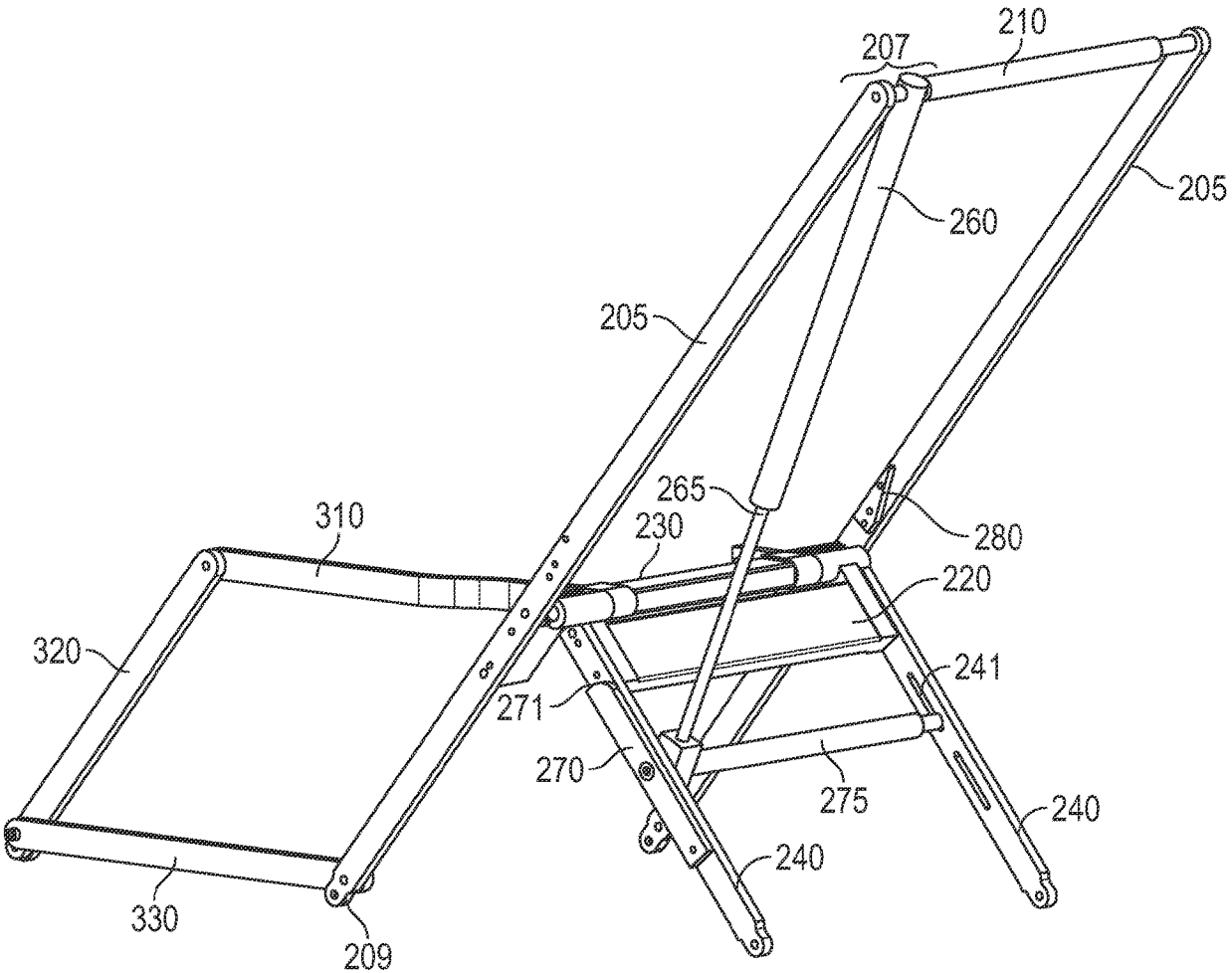
FIG. 11 is a rear and side perspective view of various lift chair components

FIG. 11 depicts a rear and side perspective view of various lift chair components and/or assemblies. For ease of viewing, the seat plates are not shown and various right hand components are not shown. Two wheelie bars 240 are attached with a cross bar 275 or lower cross bar. The lower cross bar 275 penetrates a wheelie bar longitudinal void 241 and the lower cross bar further retains a wedge bar 270. The lower cross bar may be attached to a piston 265 and cylinder 260 or other means of mechanical movement. A top end of the cylinder 260 may be attached to a top cross bar 210. As the piston 265 moves, an attached lower cross bar 275 may move a wheelie bar 240 and an attached wedge bar 270. During a lifting or decent movement of the lift chair, the lower cross bar may move within the wheelie bar longitudinal void 241.

Starting in a flat position, in a rising movement, the piston 265 may urge the lower cross bar in a medial direction and may thus cause the cambered edge 271 of the wedge bar 270 to press upon and ride upon a wedge 280 attached to a back strut 205. The wedge bar and wedge help to create the initial separation of the wheelie bar from the back strut. After the initial movement of the wheelie bar from the back strut, the piston 265 may more easily expand to further separate or move apart the back end of the back strut from the back end of the wheelie bar, wherein subsequent force from the piston produces rotational motion around the wheelie gear rather than tension in the lift components. As the back strut and wheelie bar are moved apart, the back end 207 of the back strut 205 moves off of the ground and the bottom end 209 of the back strut moves along the ground. The artful combination of the wheelie gear 220, hinge plate 230 and back gear (not shown) help to facilitate the compact design and low profile of the lift chair and the smooth lift of a patient from the ground to a raised position.

In one embodiment, an upper cross bar 210 may be pivotally attached to a piston 260 and two back struts 205. The back struts may be pivotally attached to bottom struts 330 and the bottom struts may be pivotally attached to front struts 320. Front struts 320 may be pivotally attached to seat struts 310. Seat struts 310 may be attached to a hinge plate 215, the hinge plate shown in FIG. 12.

Figure 12:
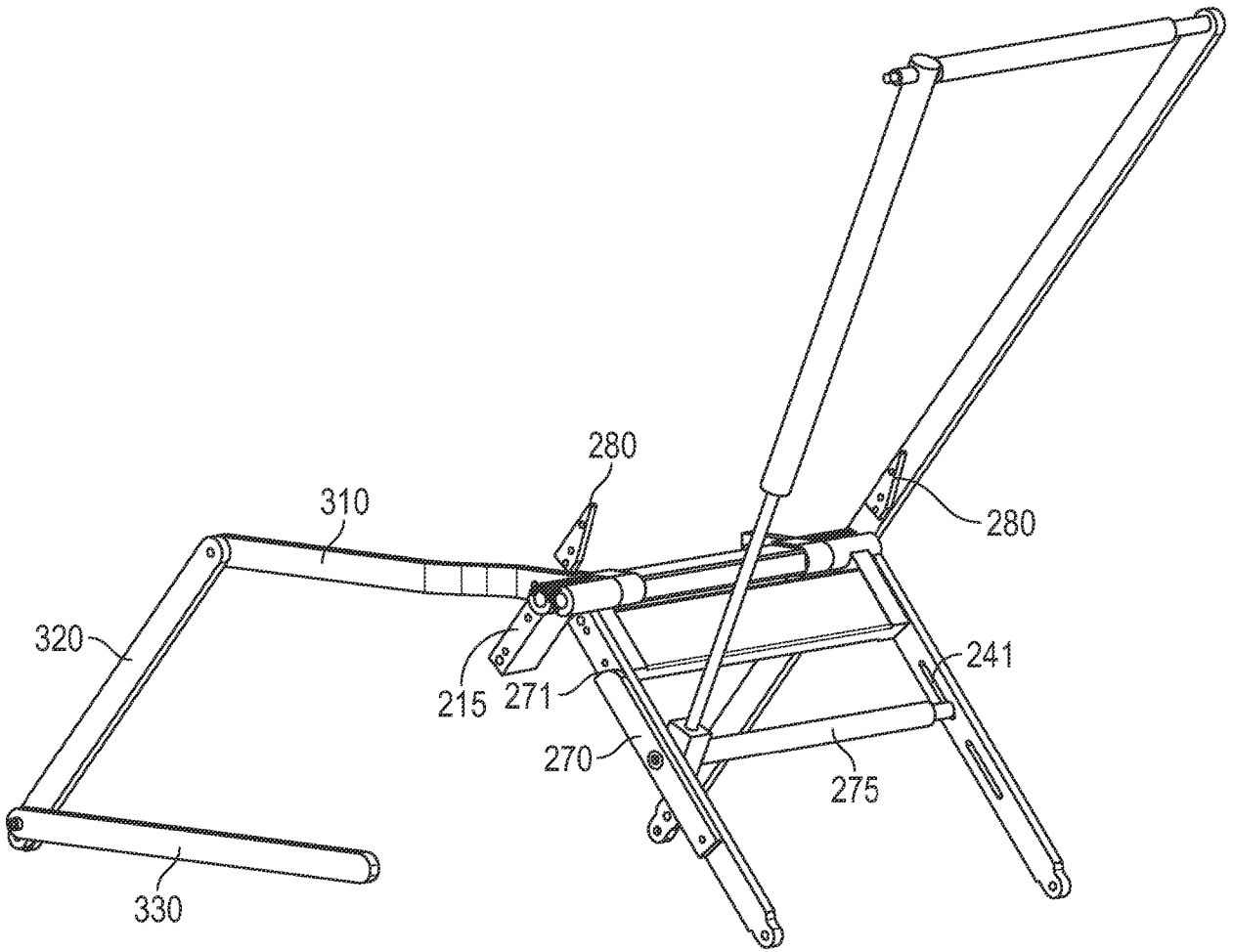
FIG. 12 is a perspective view of various components of a lift chair

FIG. 12 presents FIG. 11 but with the seat strut of the foreground removed, so as to reveal a hinge plate 215 and wedge 280 in the foreground. Wedges 280 may be attached to the inside surfaces of the back struts 205, thus the wedge 280 shown in the foreground is unattached and visible from the presented view only with the back strut removed.

Figure 13:
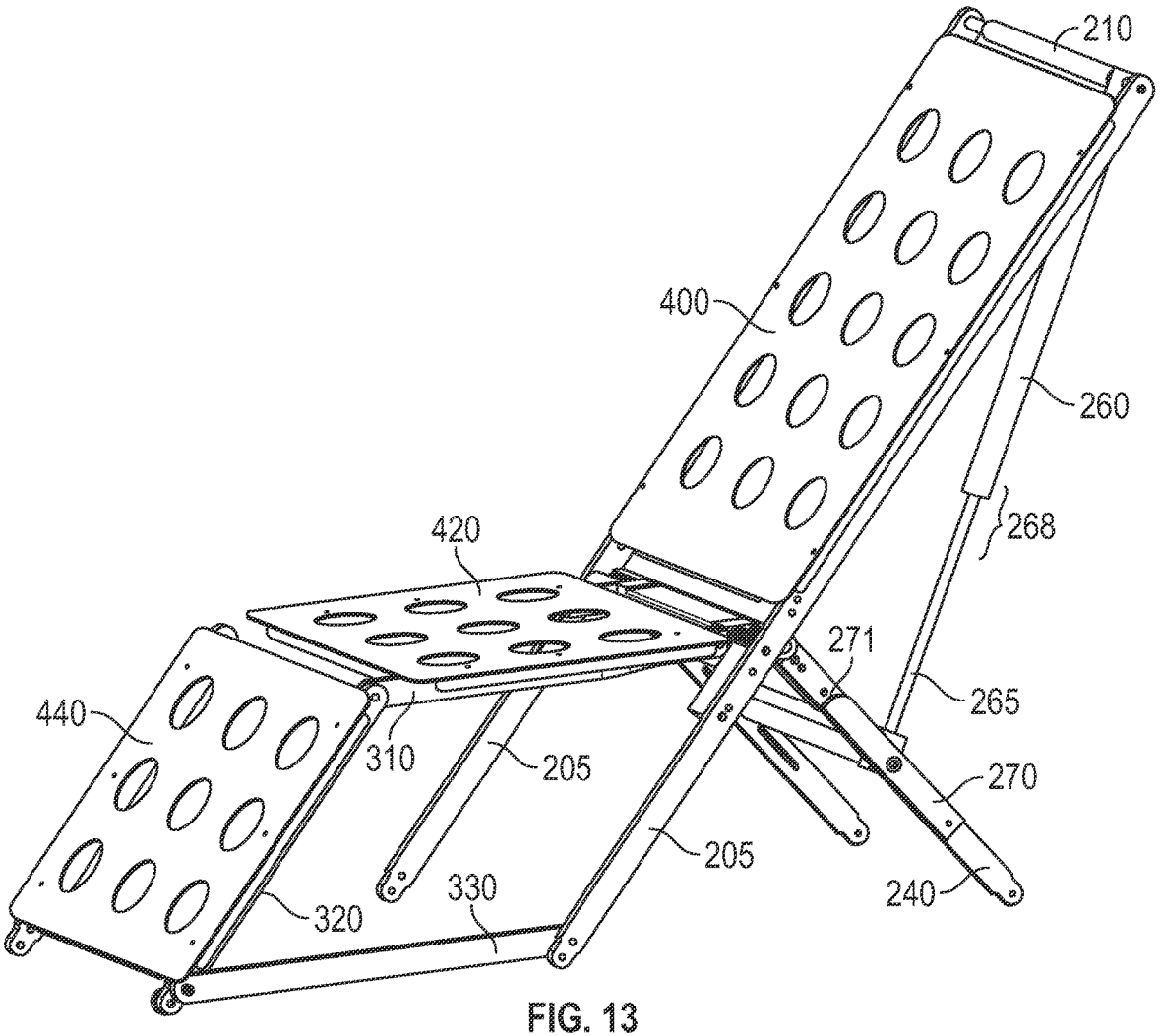
FIG. 13 is a perspective view of various components of a lift chair

FIG. 13 depicts a leg plate 440 attached to a front strut 320, a seat plate 420 attached to a seat strut 310 and a back plate attached to a back strut 205. The piston 265 and cylinder 260 may comprise a hydraulic system 268 or other means of mechanical movement.

Figure 14:
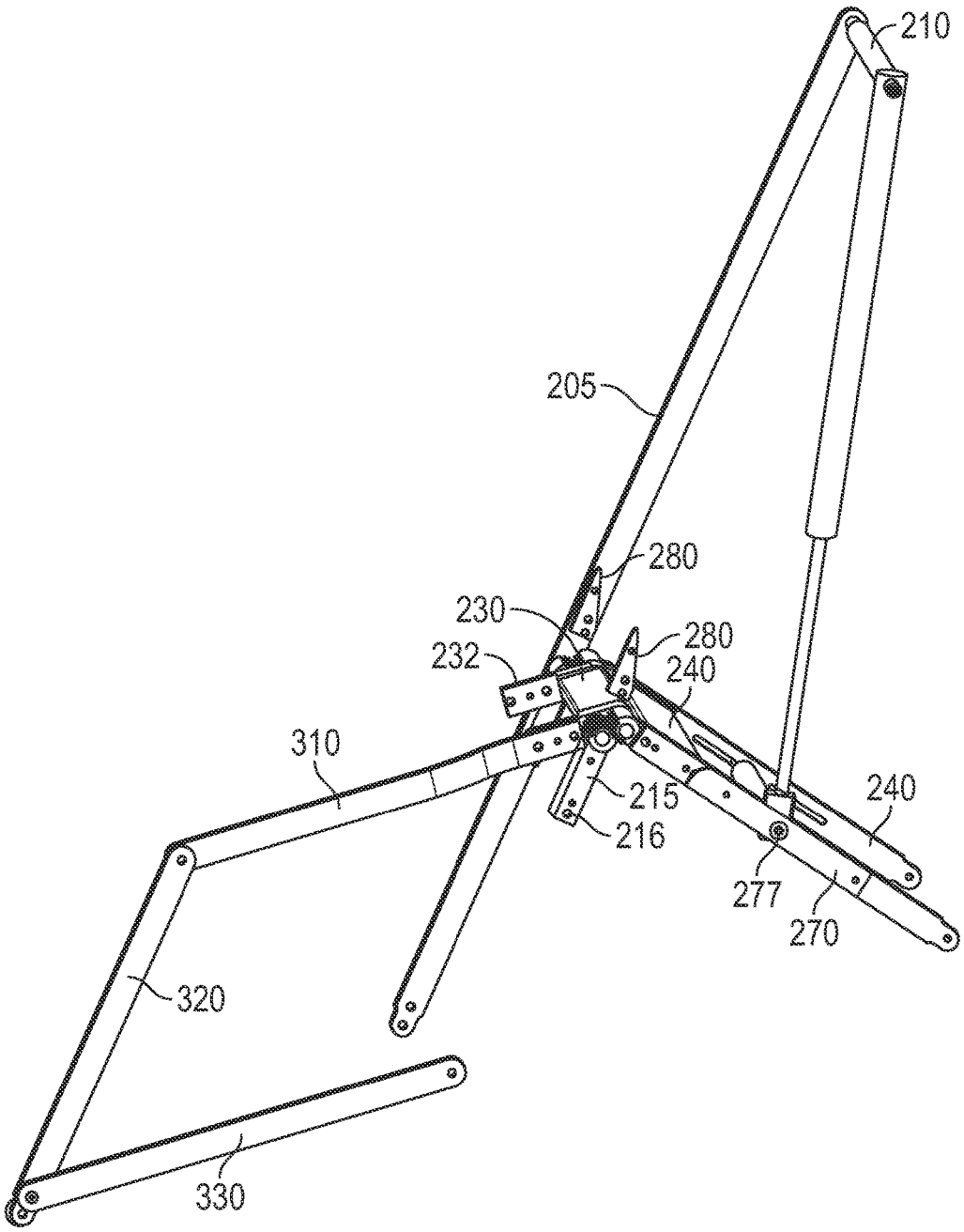
FIG. 14 is a perspective view of various components of a lift chair

FIG. 14 removes all plates and one seat strut of the back ground to reveal a hinge plate 230 having two sets of side retainer brackets 232. A side retainer bracket 232 may be rigidity attached to a seat strut 310 so as to provide a constantly level seat during the lifting process. The constant horizontal position of the hinge plate 230 and attached seat strut and seat plate is made possible by the independence of the hinge plate from the back gear 215 and wheelie bar 240. While the gear teeth of the back gear and the wheelie bar may cause the back gear and the wheelie bar to rotate upon one another, the hinge plate 230 does not rotate and moves in elevation only.

Figure 15:
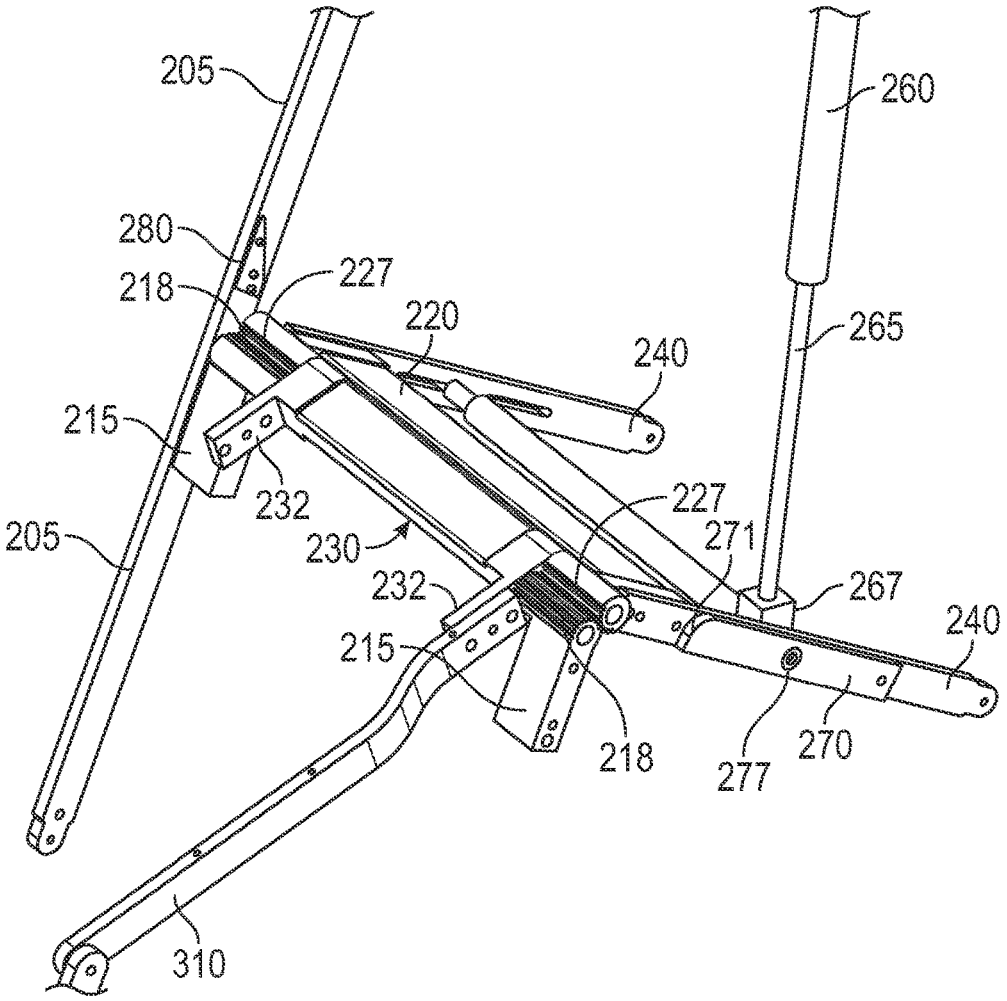
FIG. 15 is a perspective view of various components of a lift chair

FIG. 15 presents FIG. 14 in a more front perspective view and removes various components to more clearly show the back gear 215, wheelie gear 220 and hinge plate 230.

In moving the lower cross bar, a cylinder 265 may contain a piston 265, and the piston may move out of the cylinder further separating the lower cross bar from the upper cross bar. The piston 265 may be connected to a cylinder rod clevis 267 and the lower cross bar may be connected to the cylinder rod clevis 267.

The expansion, separation or movement of the upper cross bar and lower cross bar may occur by any means. The piston may be driven or controlled by use of gas, air pressure, fluid pressure or other forces, including such forces directed to the cylinder.

Figure 16:
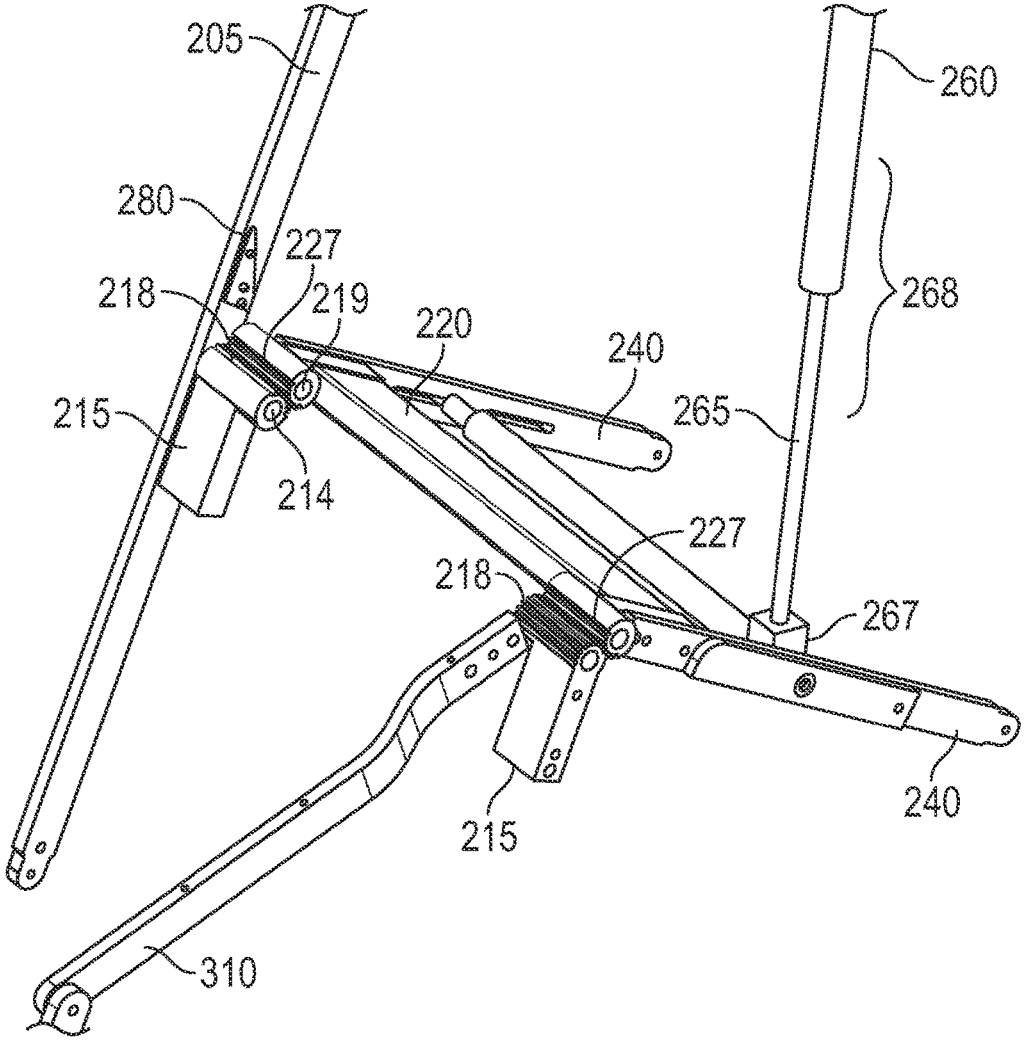
FIG. 16 is a perspective view of various components of a lift chair

FIG. 16 presents FIG. 15 with the hinge plate removed so as to more clearly show how the back gear 215 gear teeth 218 mesh with the wheelie gear 220 teeth 227. In the background, a pivot void 214 of the back gear 215 is adjacent to a pivot void 219 of the wheelie gear 220. The two pivot voids, 214, 219 may be retained or pivotally connected to the hinge plate. The back gear 215 and wheelie bar 220 may be connected by and may be moved by the intersection or meshing of the back gear 215 gear teeth 218 and wheelie gear 220 gear teeth 227. The back gear 215 may be in fixed attachment to the back strut 205 and the wheelie gear 220 may be in fixed attachment to the wheelie bar 240. A seat strut 310 is shown unattached, to reflect the attachment to the omitted hinge plate.

Figure 17:
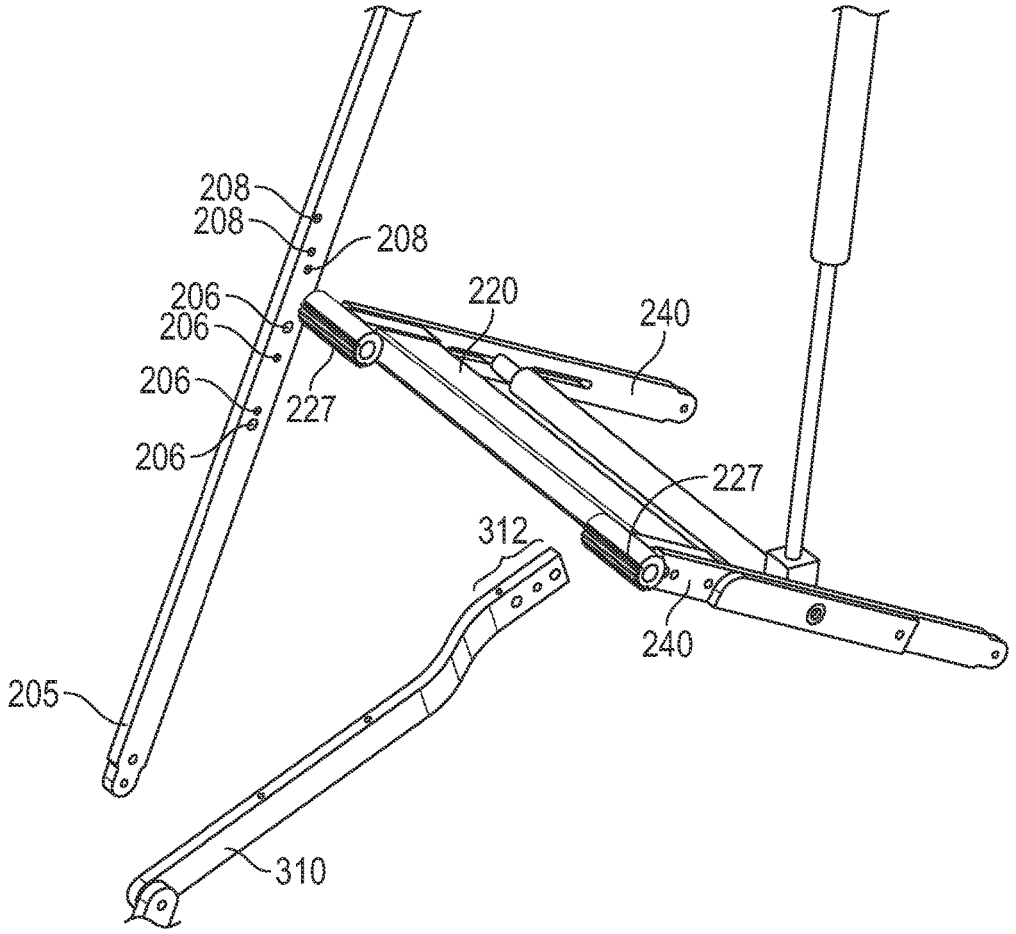
FIG. 17 is a perspective view of various components of a lift chair

FIG. 17 presents FIG. 16 with the back gear omitted. A back strut 205 is shown in the background and the wedge has been omitted to better reveal voids 208 used to retain the wedge. The omission of the wedge reveals voids 206 of the back strut used to rigidly retain the wedge.

Figure 18:
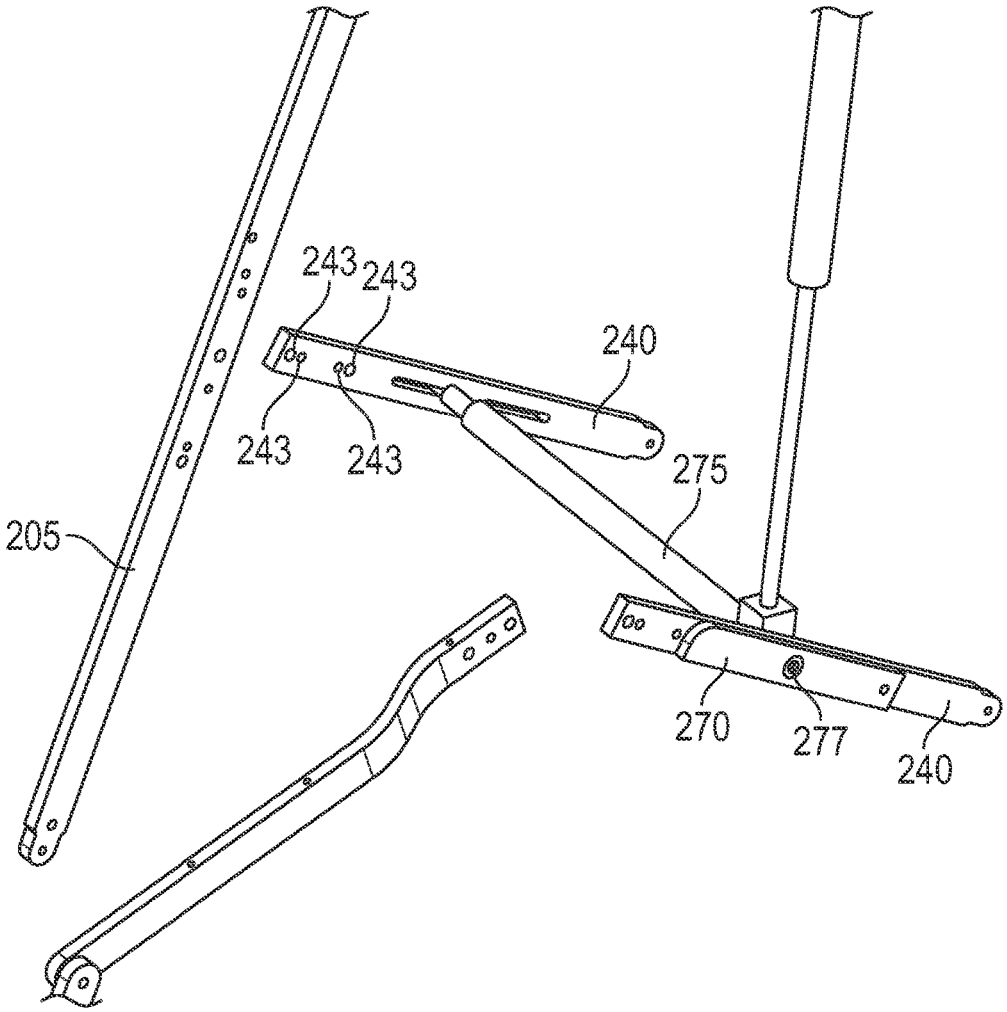
FIG. 18 is a perspective view of various components of a lift chair

FIG. 18 presents FIG. 17 with the wheelie gear omitted to better reveal the wheelie bar 240 and the attachment voids 243 of the wheelie bar used to retain the wheelie gear. The wheelie gear may be in fixed attachment to the wheelie bar. The wedge bar 270 may be in sliding attachment to the wheelie bar 240.

Figure 19:
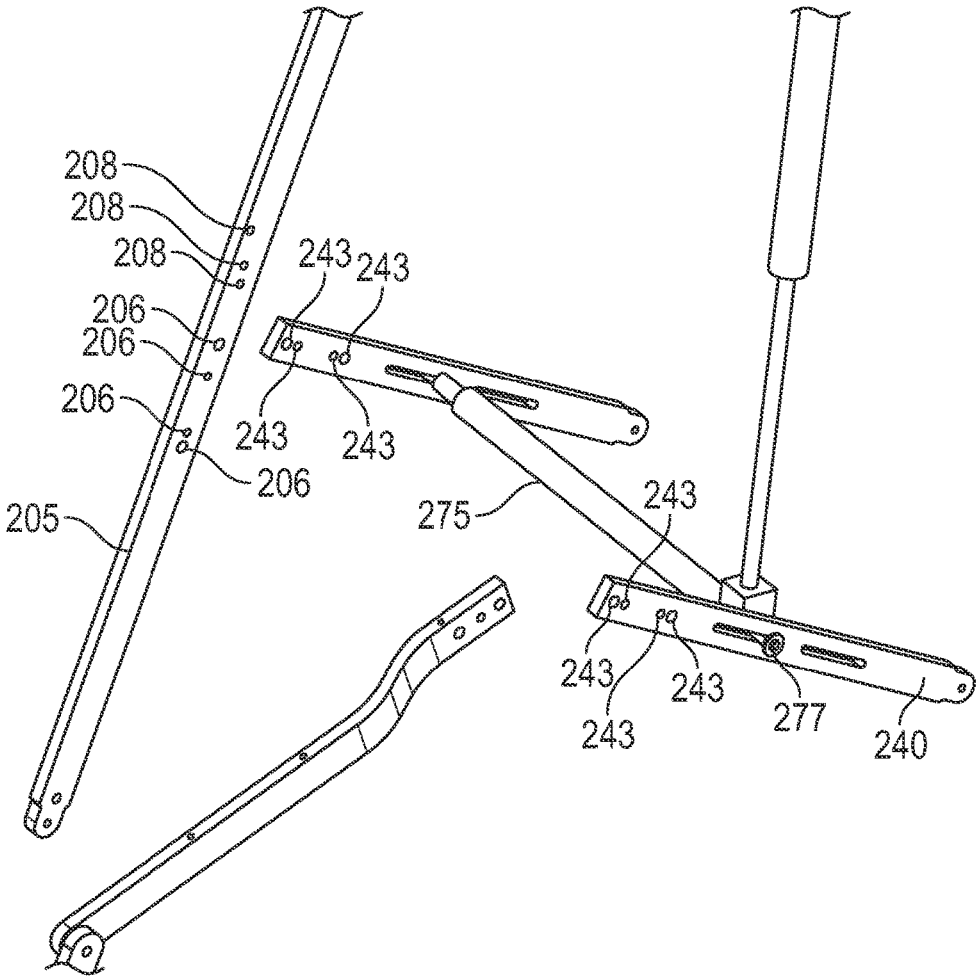
FIG. 19 is a perspective view of various components of a lift chair

FIG. 19 presents FIG. 18 with the wedge bar omitted to better reveal the lower cross bar 275 extending though the longitudinal void 241 of the wheelie bar 240. Either end of the lower cross bar 275 may comprise a washer nipple that retains a washer 277. The washer nipple and washer move the wedge bar as needed to press upon the wedge when the lift is moving from a flat to raised position.

Figure 20:
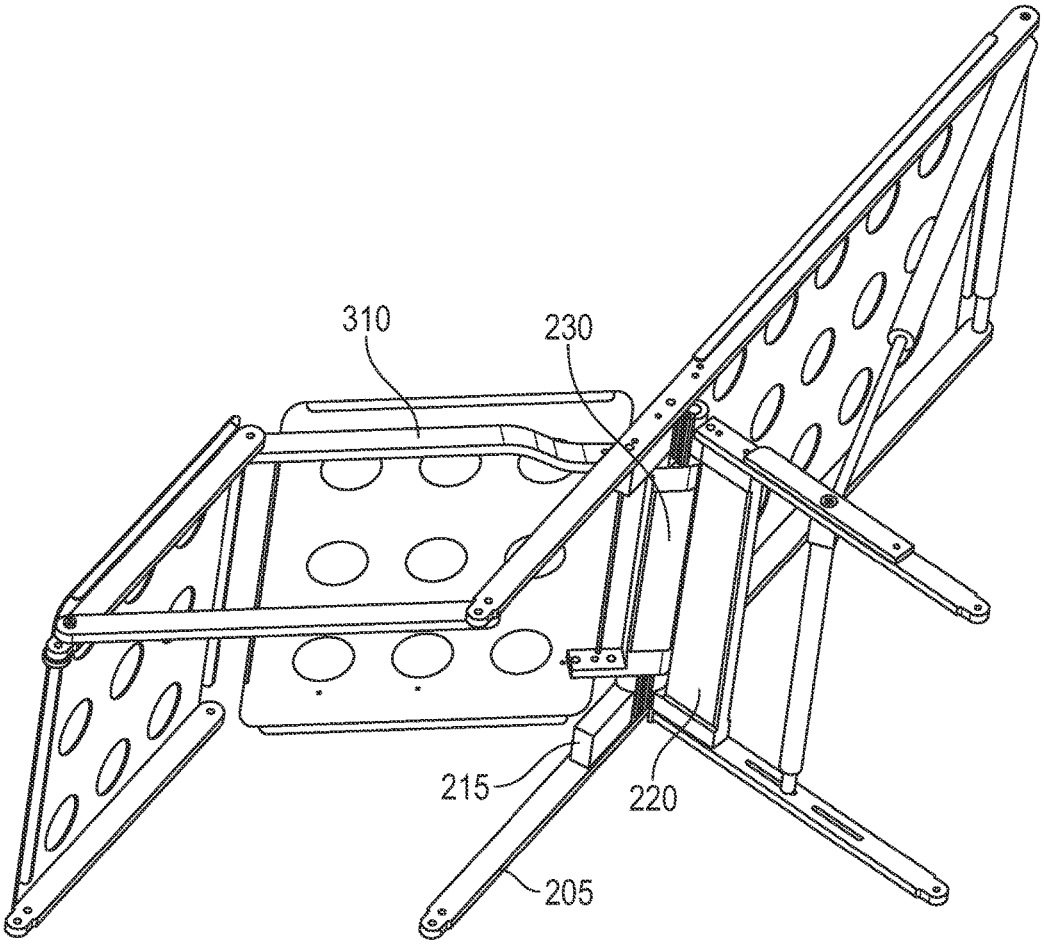
FIG. 20 is a perspective view of various components of a lift chair

FIG. 20 depicts a bottom perspective view of a lift chair in an expanded position. In an expanded position, the wheelie gear 220 and back gear 215 may be at approximately the same angle from the hinge plate.

Figure 21:
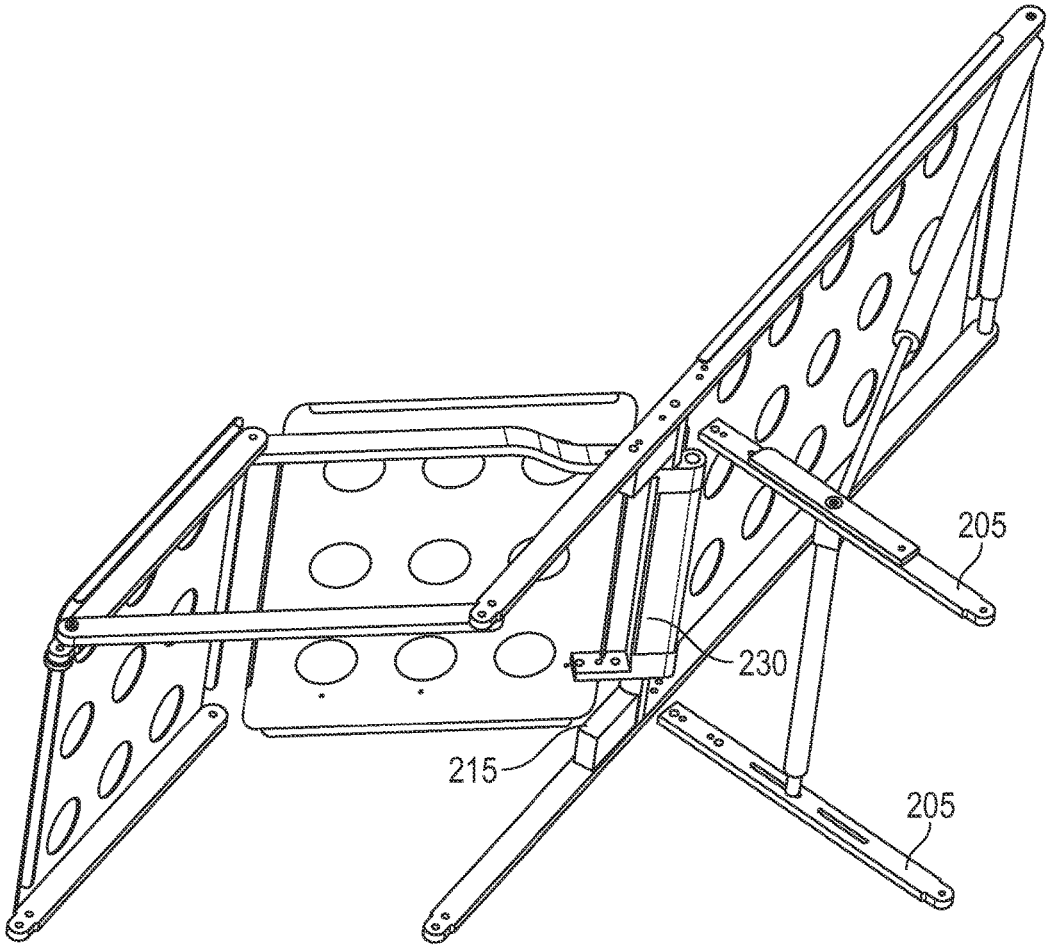
FIG. 21 is a perspective view of various components of a lift chair

FIG. 21 presents FIG. 20 with the wheelie gear 220 omitted to reveal independence or free floating of the two back struts 205.

Figure 22:
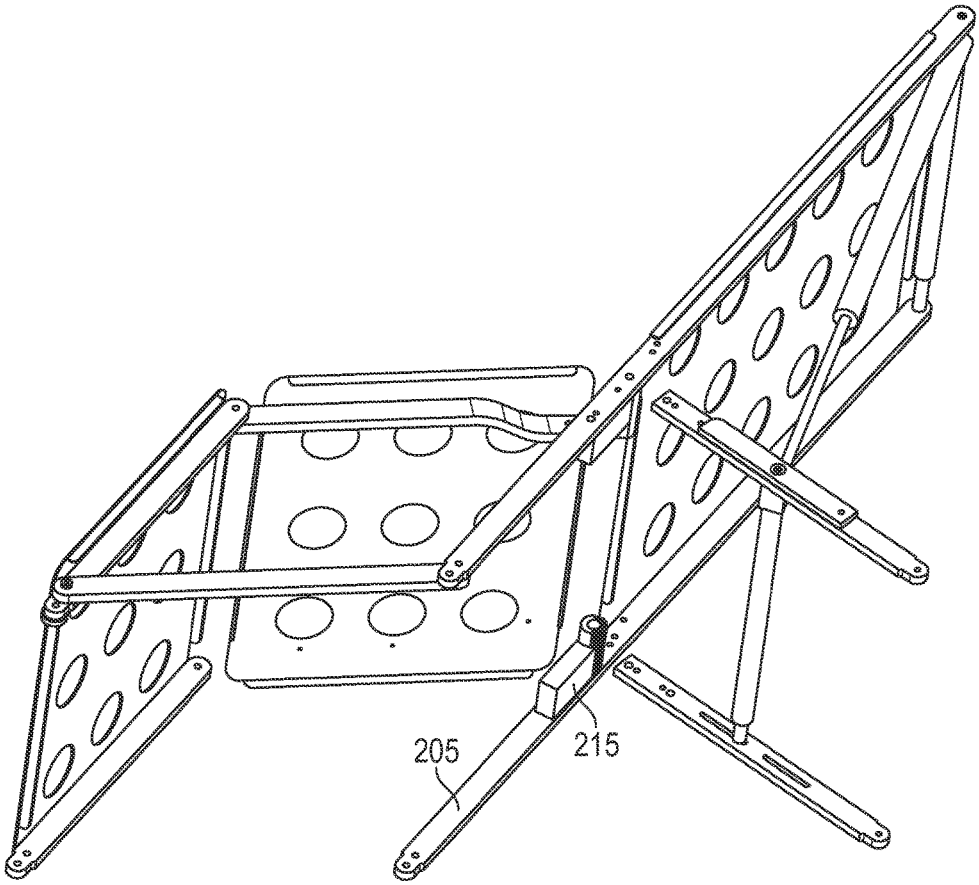
FIG. 22 is a perspective view of various components of a lift chair

FIG. 22 presents FIG. 21 with the hinge plate 230 omitted to reveal the back gears 215.

Figure 23:
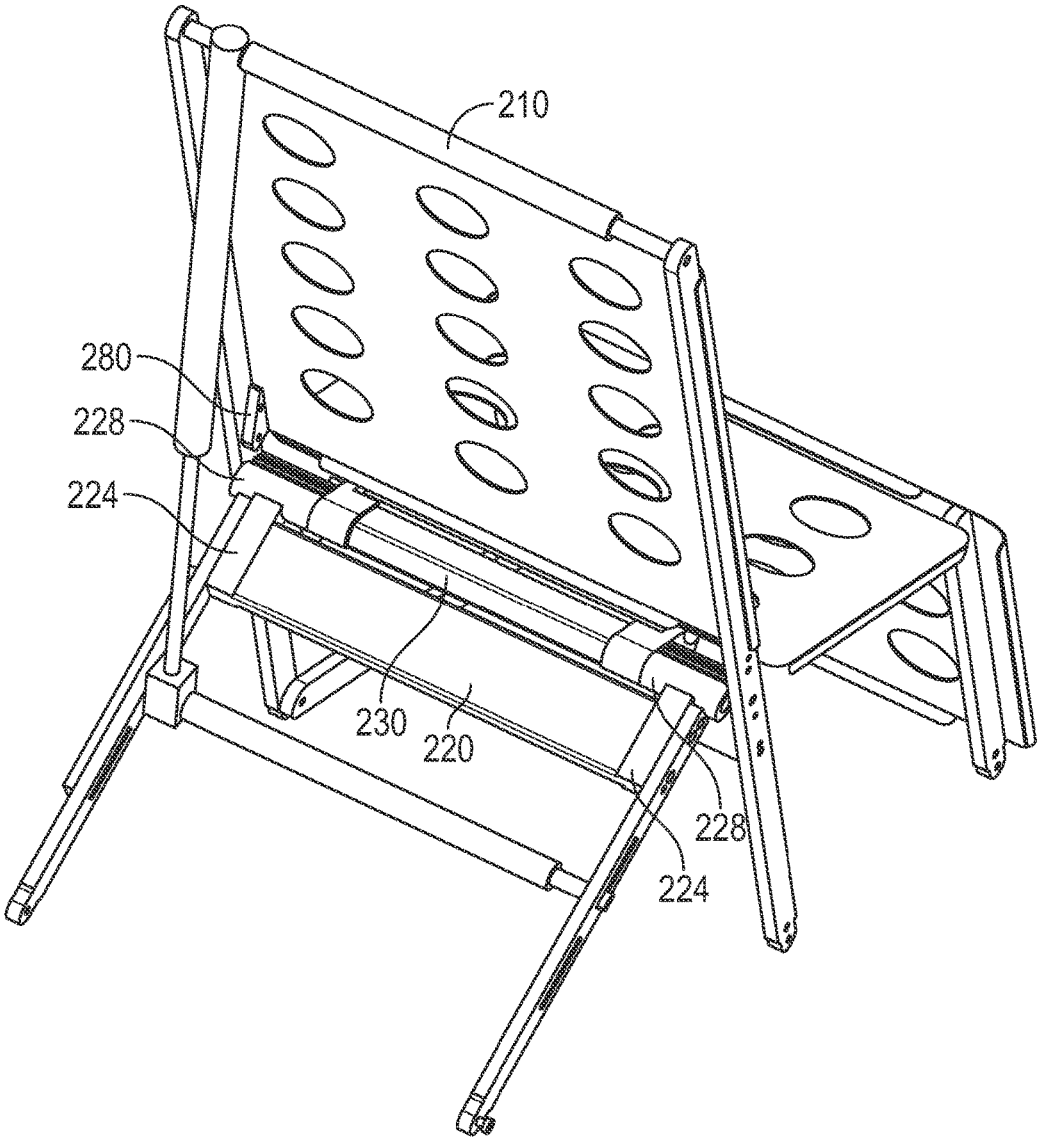
FIG. 23 is a perspective view of various components of a lift chair
Figure 24:
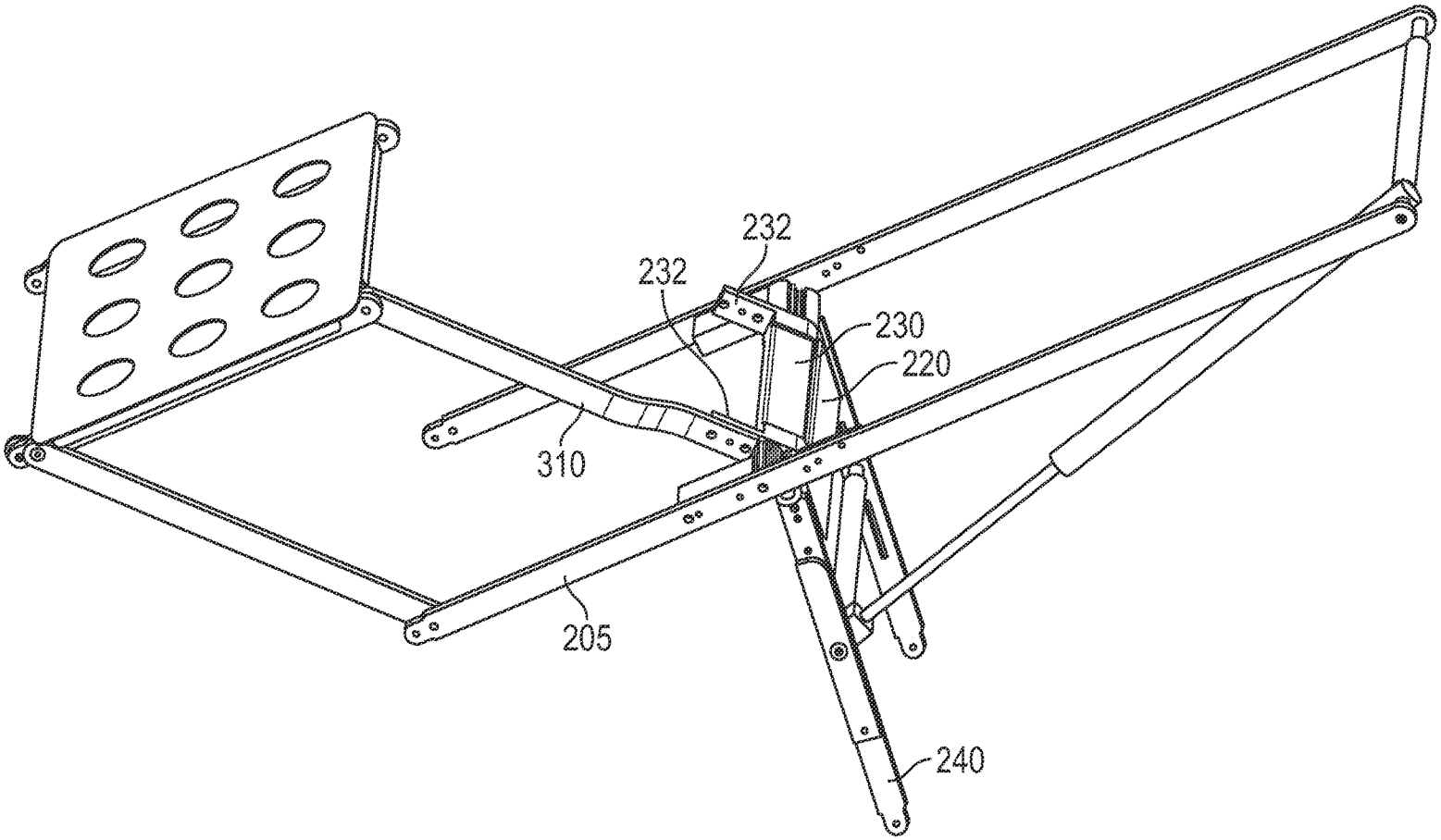
FIG. 24 is a perspective view of various components of a lift chair

FIG. 23 depicts a rear and side perspective view of a lift chair in an expanded or raised position to better reveal a wheelie gear 220 comprising side bars 224 and pivot heads 228, FIG. 24 presents FIG. 23 from a side view and with the seat plate and back plate omitted. Disclosed embodiments include the use of a single back strut, seat strut, wheelie bar, wedge, wedge bar, front strut, bottom strut, back gear, piston and cylinder used with a hinge plate and wheelie gear.

Figure 25:
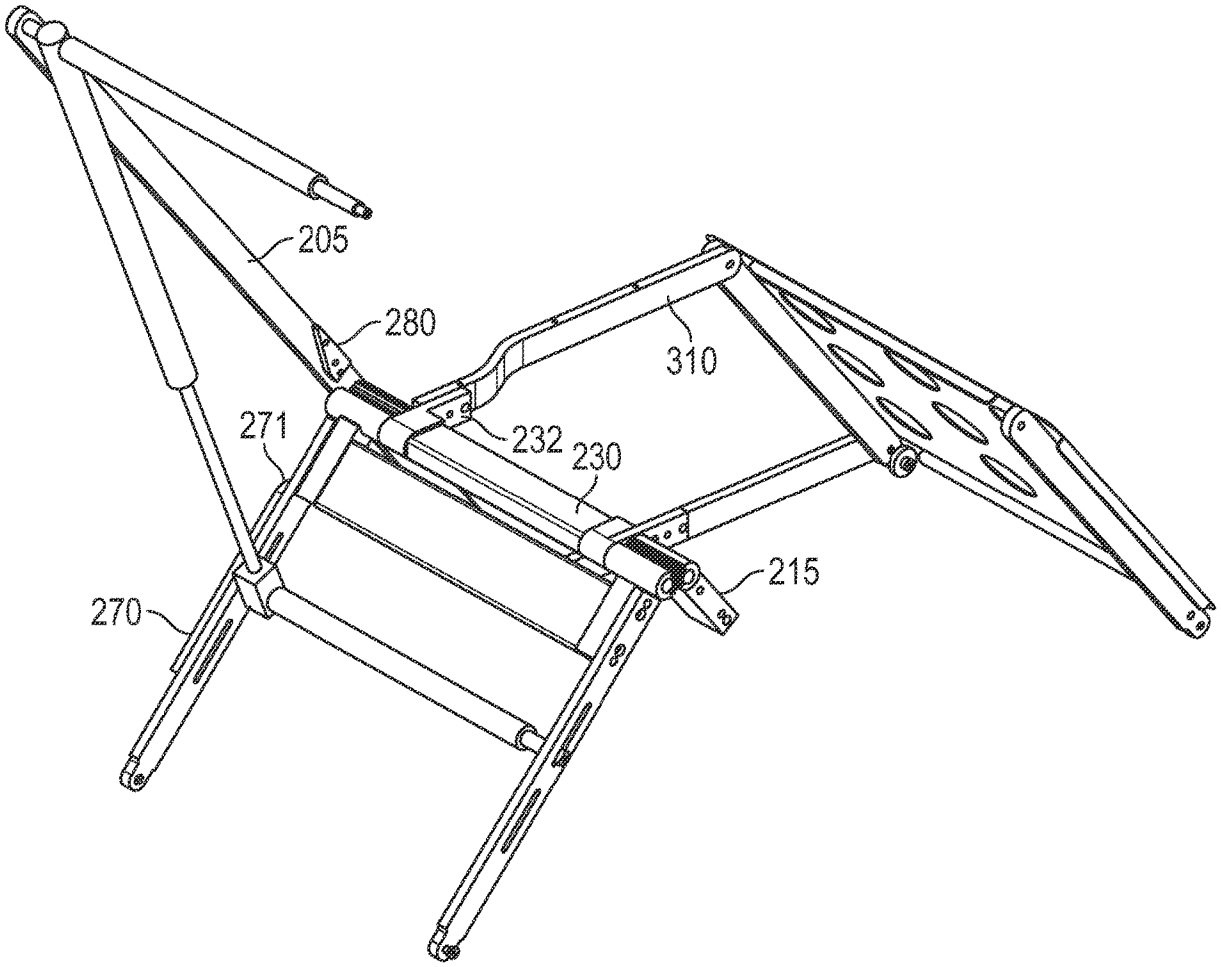
FIG. 25 is a perspective view of various components of a lift chair

FIG. 25 depicts various components from an alternative perspective view.

Figure 26:
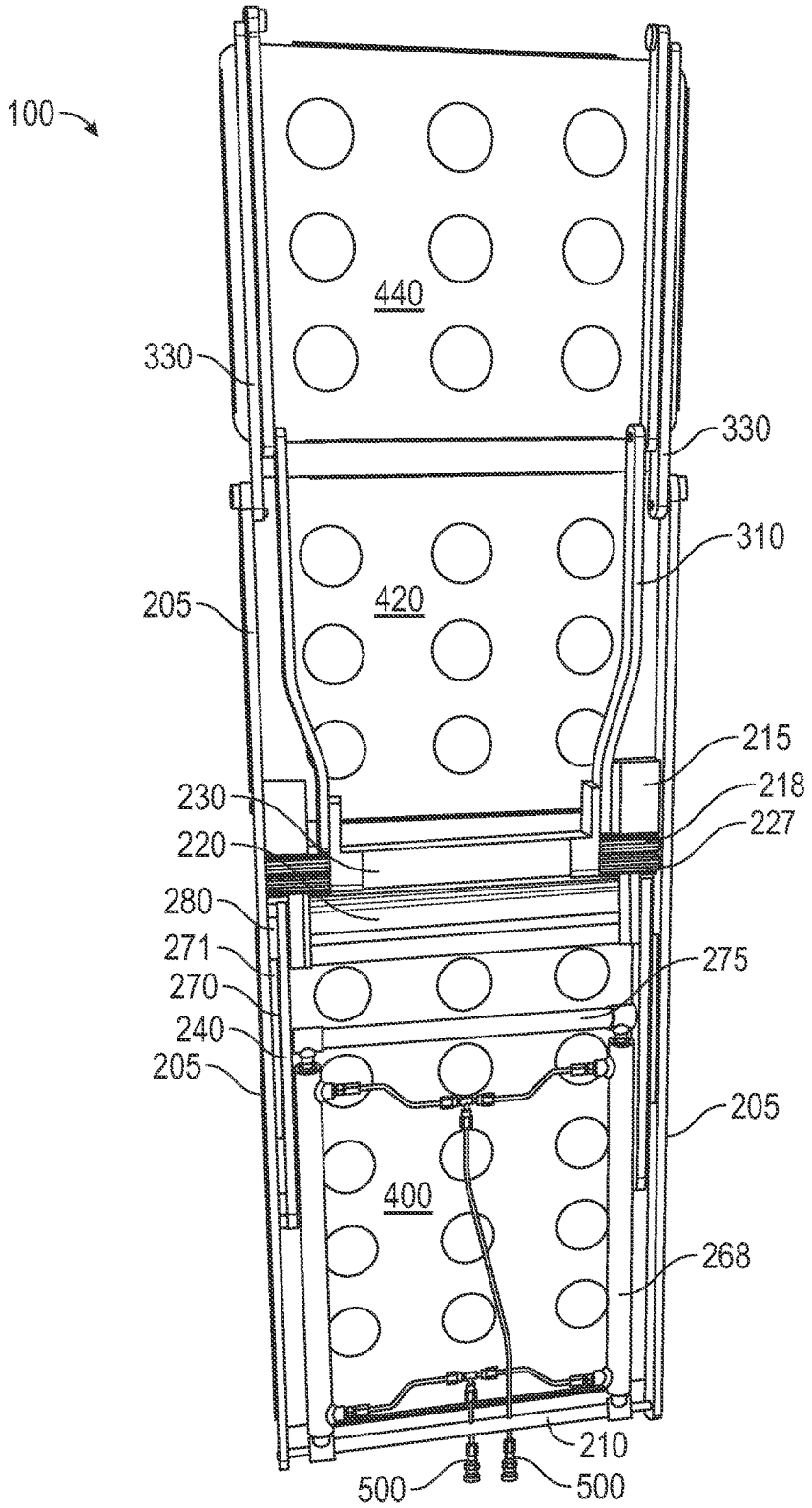
FIG. 26 is a perspective view of a lift chair in a flat position

FIG. 26 depicts a perspective view of a lift chair 100 in a flat position. Disclosed embodiments overcome shortfalls in the art by achieving a low profile by use of components that are one layer in height. For example, other than the thin leg plate 440, seat plate 420 and back plate 400 components are not stacked or disposed vertically upon each other, but instead, are disposed inwardly, along a horizontal plane. Most components are between the back struts 205 and bottom struts 330. A low profile is further achieved by the wheelie bar 220, hinge plate 230 and back gears 215 disposed in a planar or flat position when the lift is ready to accept a patient from the ground. A mechanical system, such as hydraulic tubing may be used to apply force to the lower crossbar.

Figure 27:
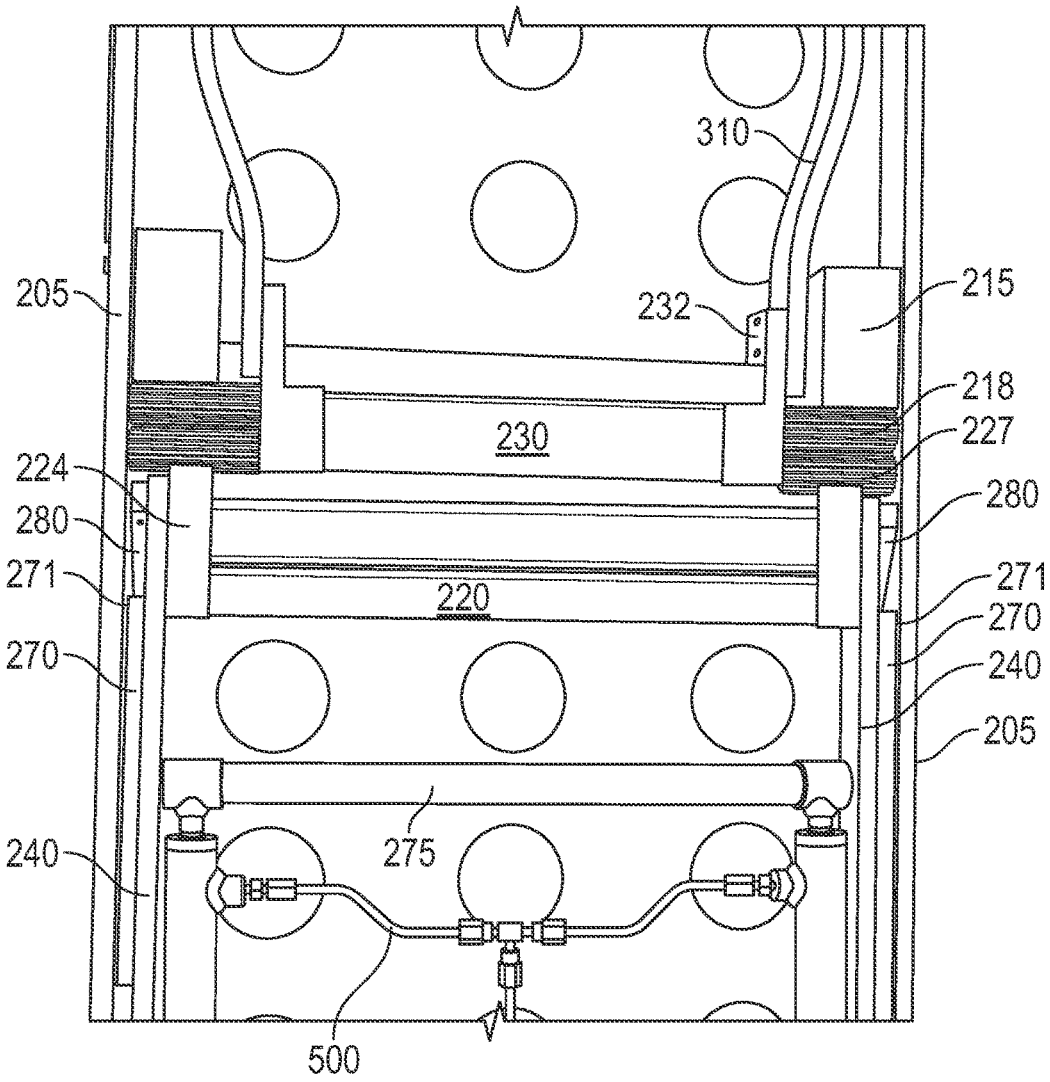
FIG. 27 is an expanded perspective view of a lift chair in a flat position

FIG. 27 depicts a perspective view of selected components that include wedges 280 attached to back struts 205. The wedges 280 will guide or urge the wedge bars 270 in a vertical direction as the piston moves the cross bar toward the hinge plate. During the lifting motion, the lower cross bar 275 may move forward, back within the slot void or longitudinal void 241 of the wheelie bar 240. FIG. 27 also depicts the meshing of the back gear 215 gear teeth 218 and the wheelie gear 220 gear teeth 227.

Figure 28:
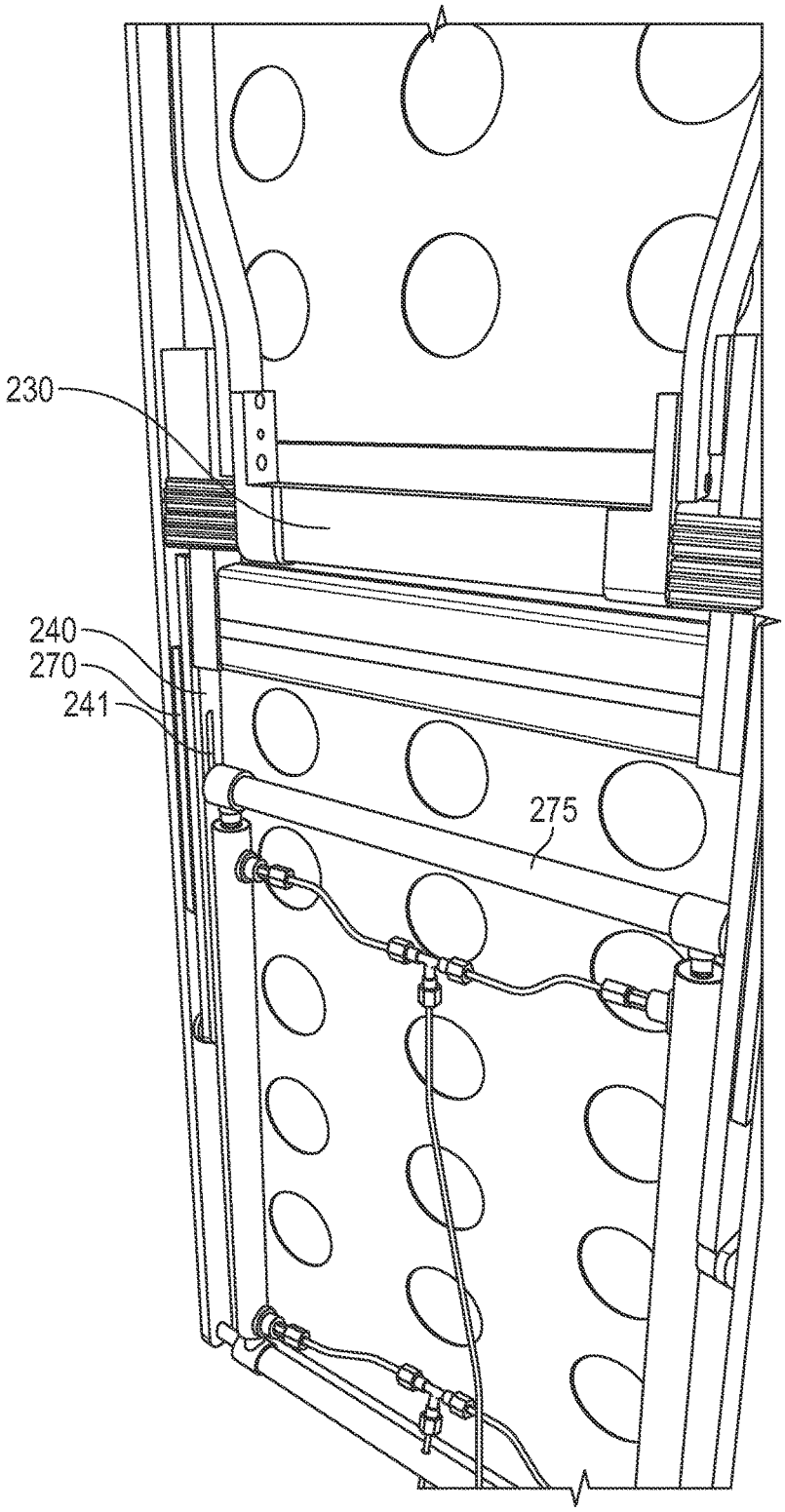
FIG. 28 is an expanded perspective view of a lift chair in a flat position

FIG. 28 depicts a perspective view of lift in a closed position wherein there is travel room within the longitudinal void 241 of the wheelie bar 240 to allow the lower cross bar 275 to move the wedge bar 240 toward the hinge plate 230.

Figure 29:
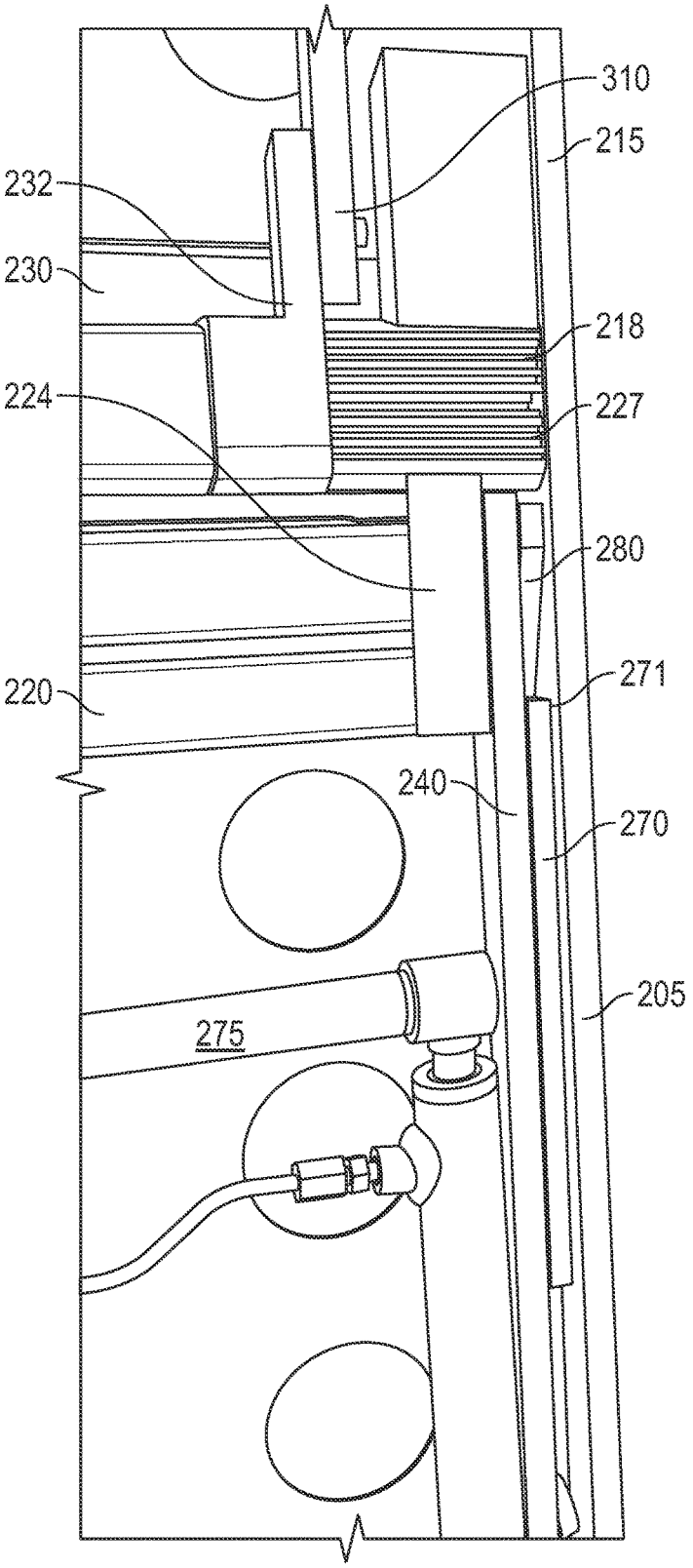
FIG. 29 is an expanded perspective view of a lift chair in a flat position

FIG. 29 is a perspective view of a lift and depicts the relationship between a wedge bar 270 and a wedge 280.

Figure 30:
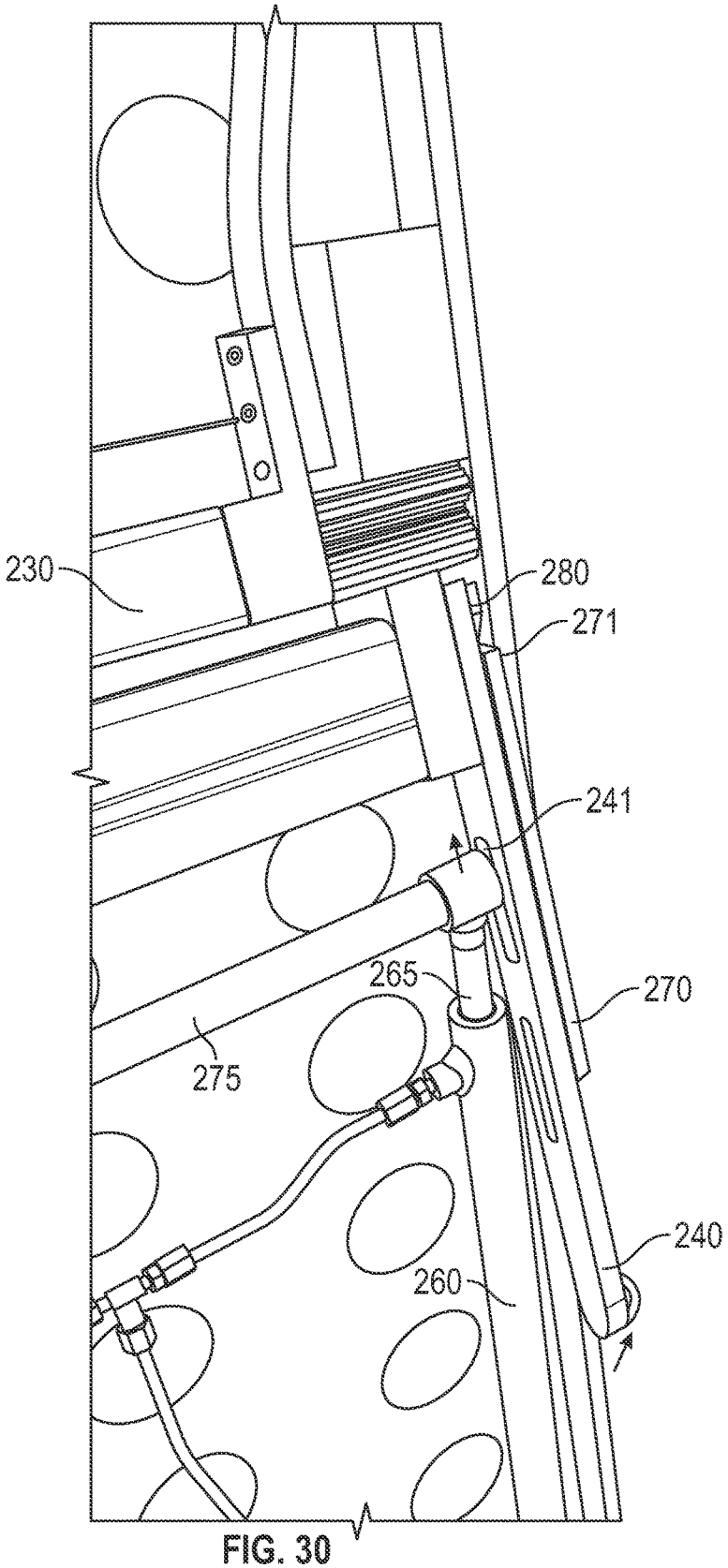
FIG. 30 is a perspective view of a lift chair in a near flat position

FIG. 30 is a perspective view of a lower cross bar 275 moving toward the hinge plate 230 and causing a vertical movement of the wheelie bar 240 due to the wedge bar 270 rising upon the wedge 280. This mechanism is artful and unobvious as the lower cross bar 275 may vertically move the wheelie bar 240 by exerting force to the longitudinal sides or walls of the wheelie bar 240 longitudinal void 241, wherein subsequent force from the piston produces rotational motion around the wheelie gear rather than tension in the lift components. In the initial movement from the flat position, the lower cross bar 275 may ride freely within the wheelie bar as the lower cross bar independently moves the wedge bar upon the wedge. Extending the lower cross bar through the wall of the wheelie bar to reach the wedge bar overcomes shortfalls in the art by saving space, avoiding the need for a second pump or piston to initiate vertical movement and by layering components horizontally and inwardly to achieve a low initial profile.

Figure 31:
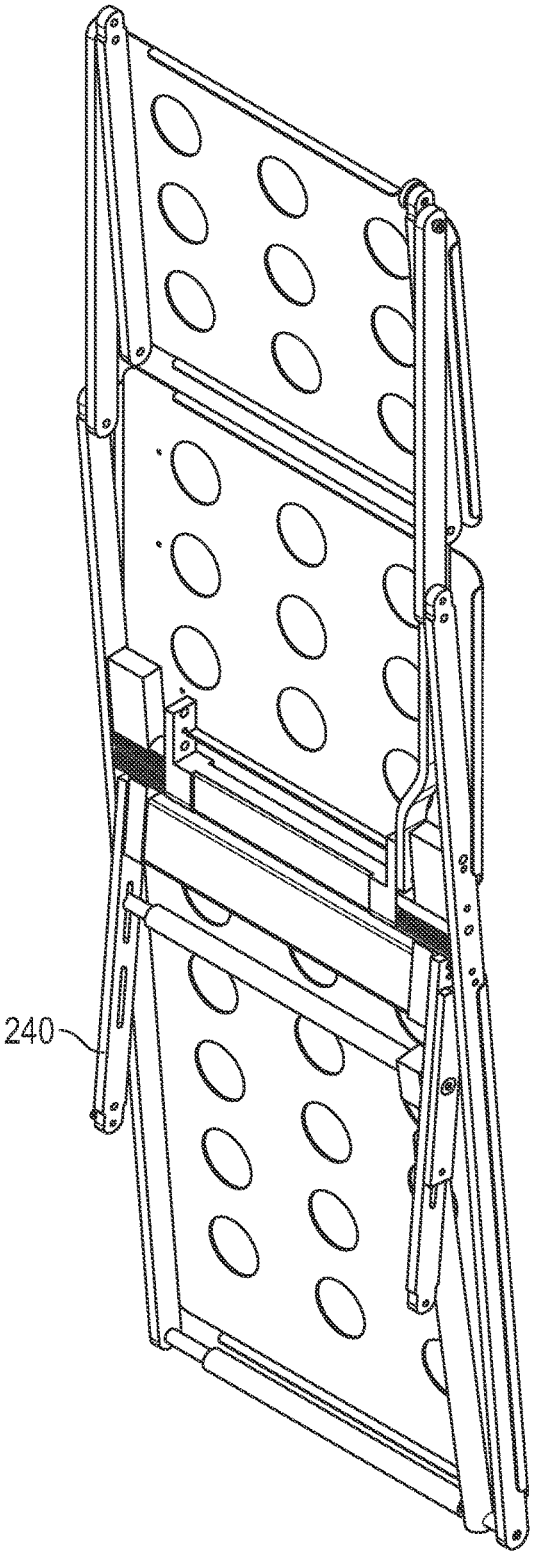
FIG. 31 is a perspective view of a lift chair in a near flat position

FIG. 31 depicts a perspective view of lift with a wheelie bar 240 moved just above horizontal.

Figure 32:
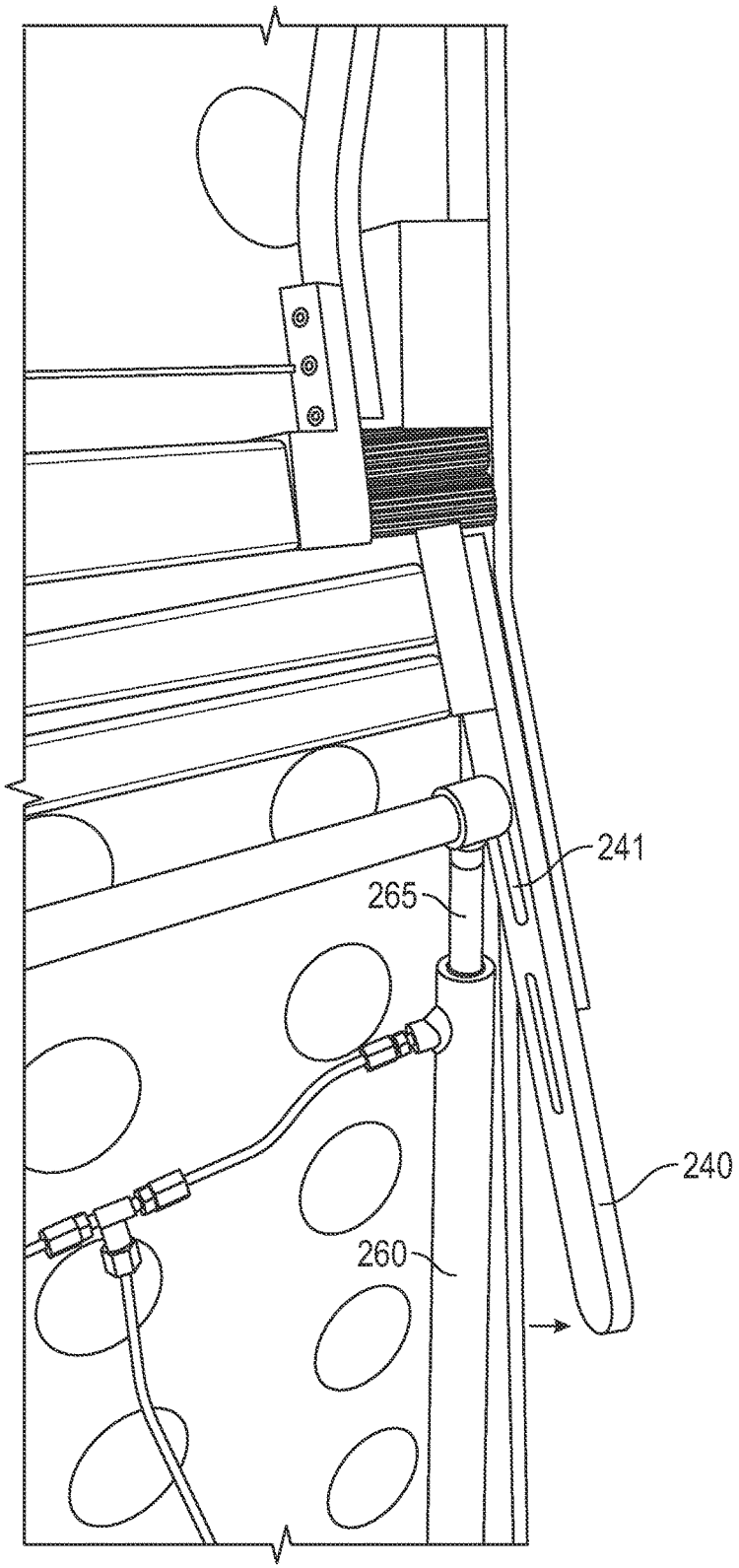
FIG. 32 is an expanded perspective view of a lift chair in a near flat position

FIG. 32 is a perspective view depicts a further movement of the wheelie bar.

Figure 33:
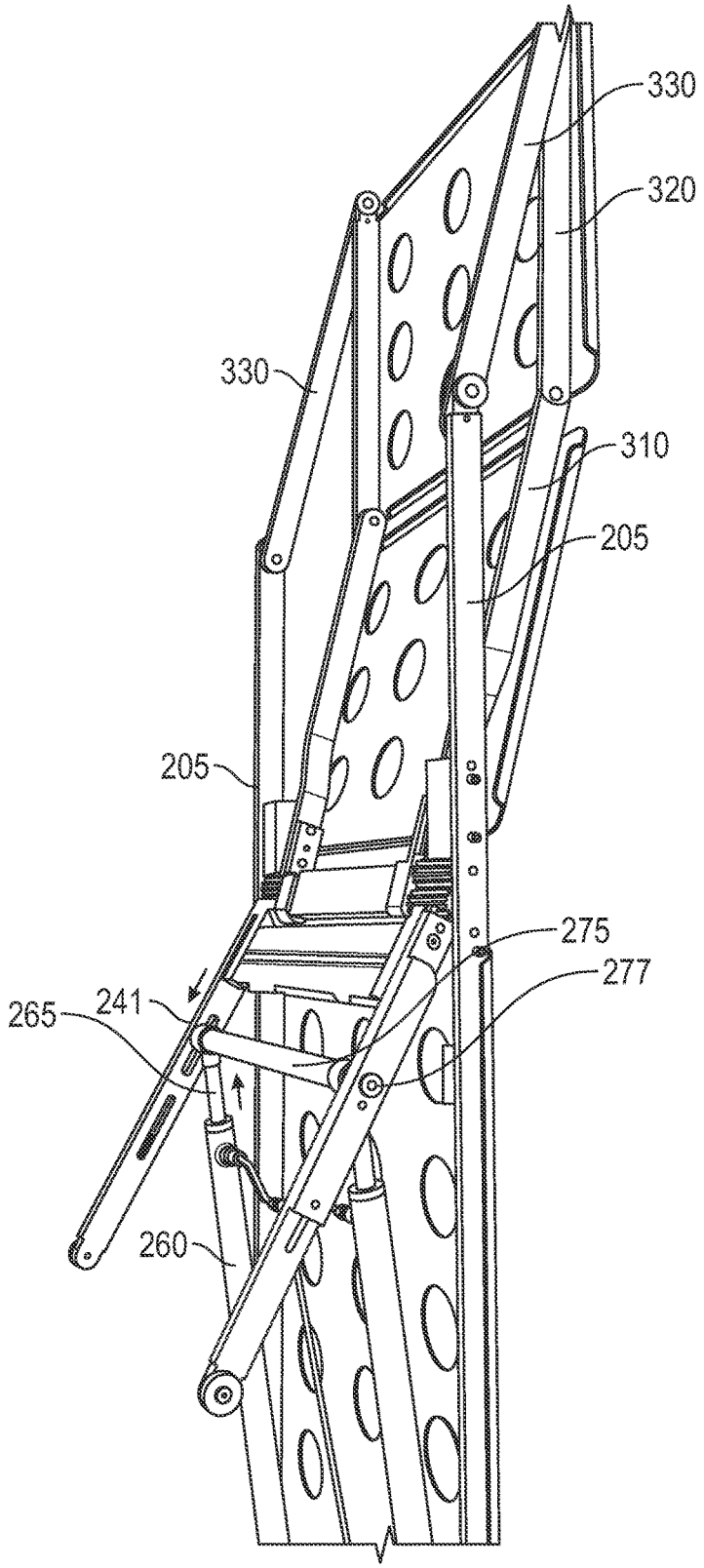
FIG. 33 is a perspective view of a lift chair in a near flat position

FIG. 33 depicts a perspective view of a lift wherein the back strut 205 has moved from the seat strut 310.

Figure 34:
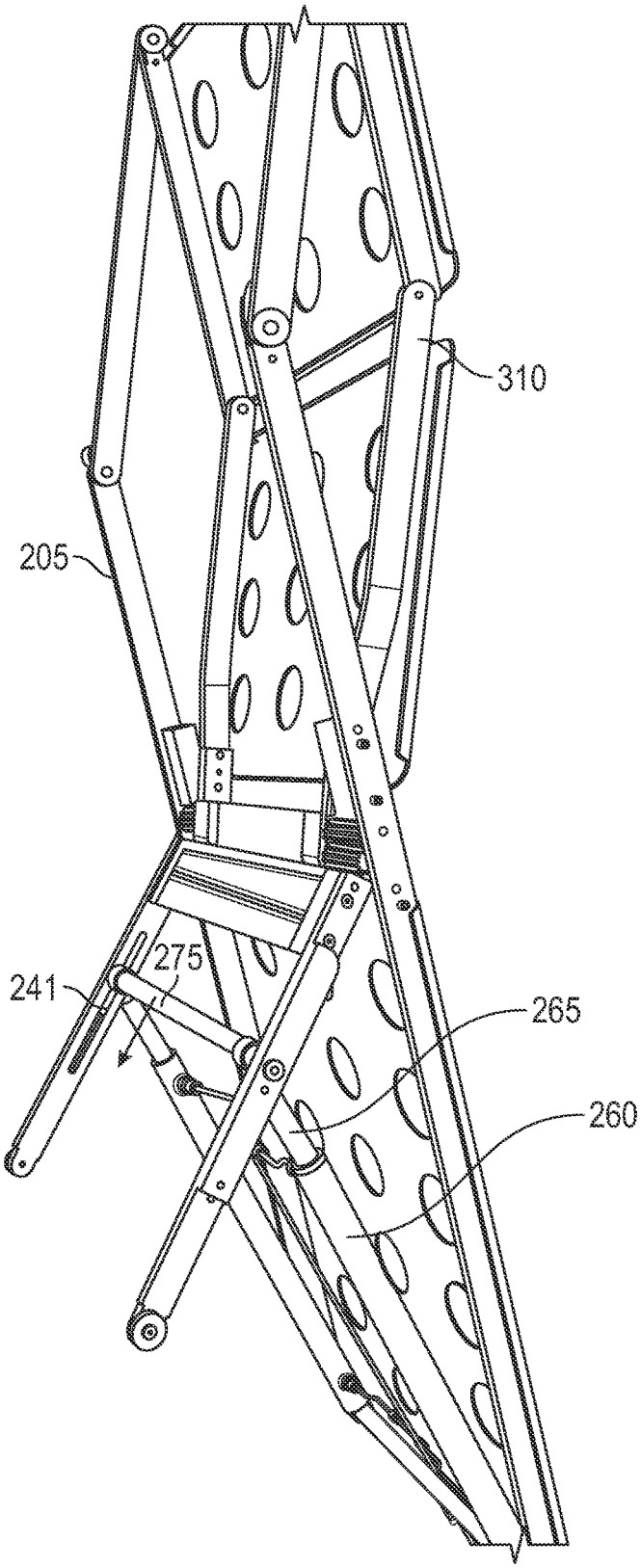
FIG. 34 is a perspective view of a lift chair in a near flat position

FIG. 34 depicts an expanded view of FIG. 33.

Figure 35:
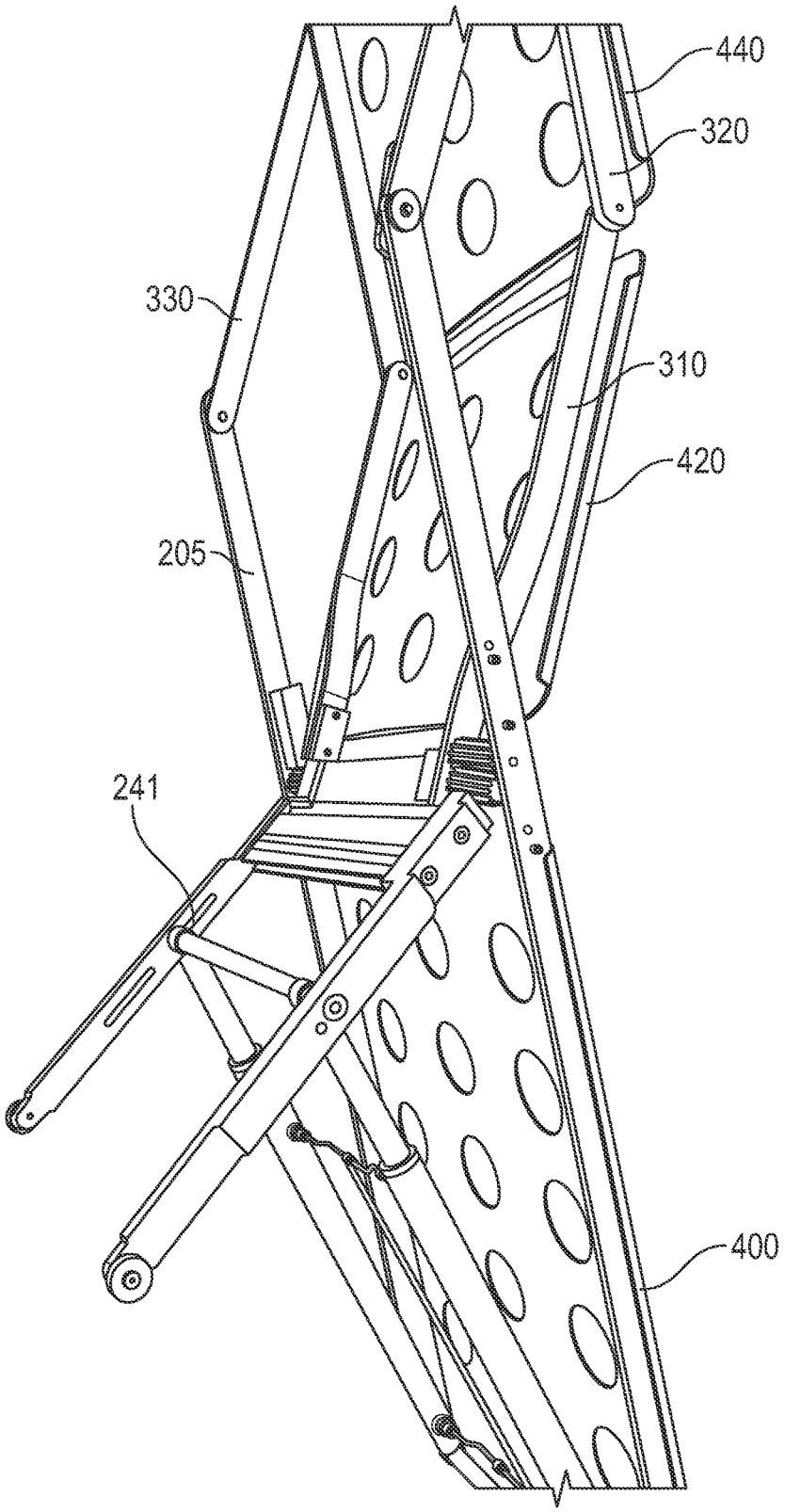
FIG. 35 is a perspective view of a lift chair in a near expanded position

FIG. 35 depicts a perspective view of a lift in a more open position as compared to FIG. 34.

Figure 36:
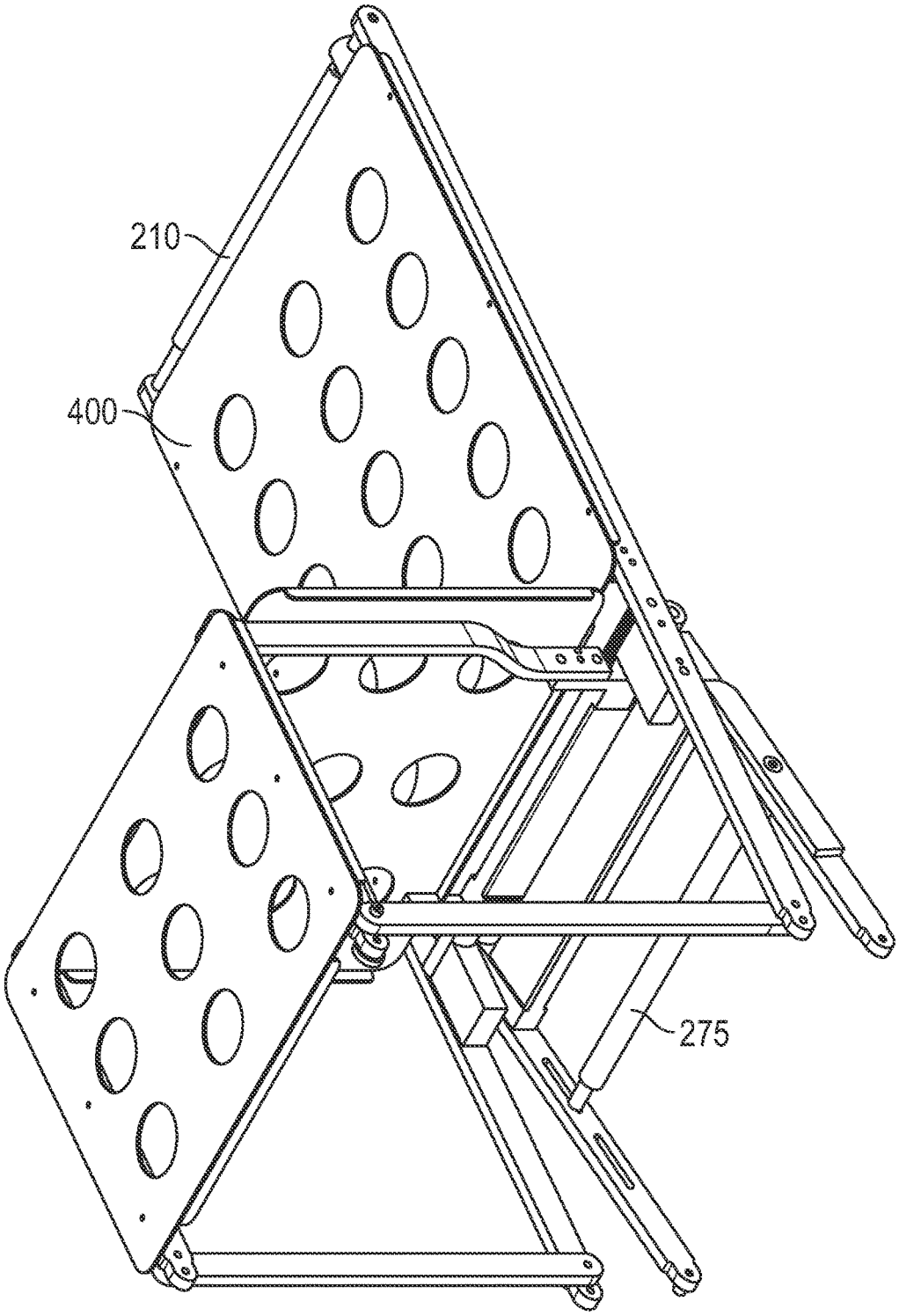
FIG. 36 is a perspective view of a lift chair in a near expanded position

FIG. 36 depicts a perspective view of a disclosed lift.

Figure 37:
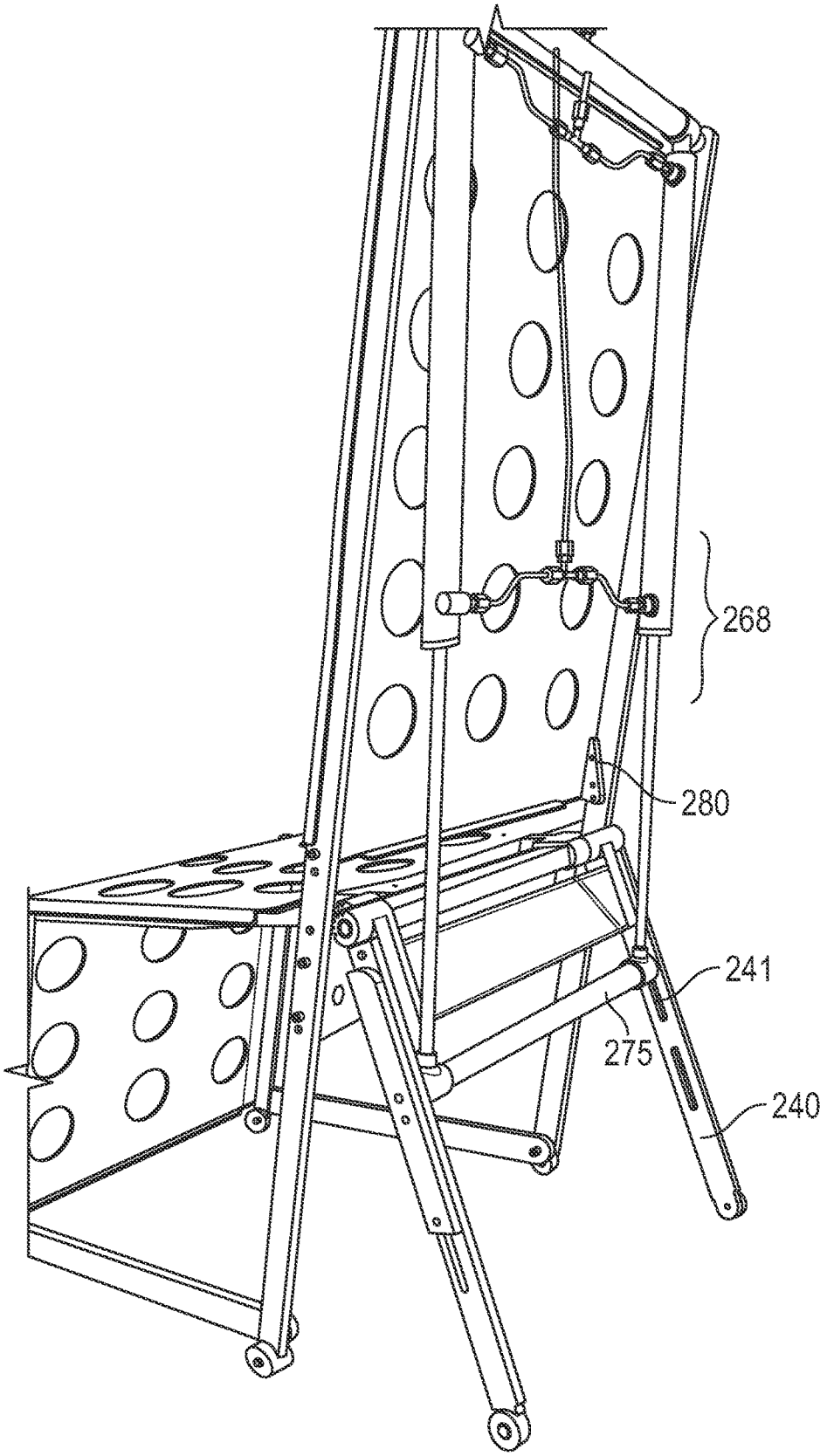
FIG. 37 is a perspective view of a lift chair in a near expanded position

FIG. 37 depicts a perspective view of a disclosed lift expanded to a seated position.

Figure 38:
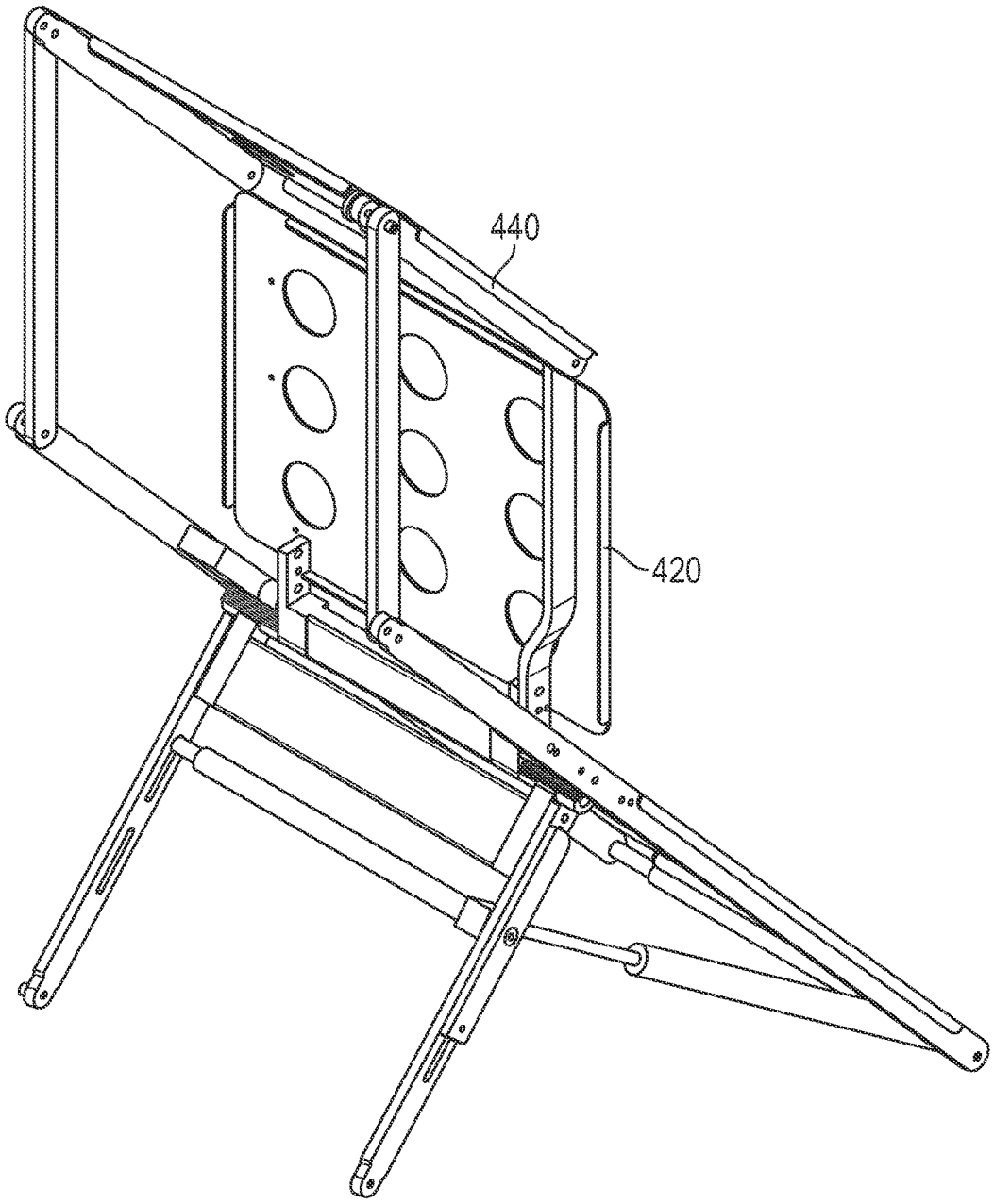
FIG. 38 is a perspective view of a lift chair in a near expanded position

FIG. 38 depicts a bottom and side perspective view of a disclosed lift.

Figure 39:
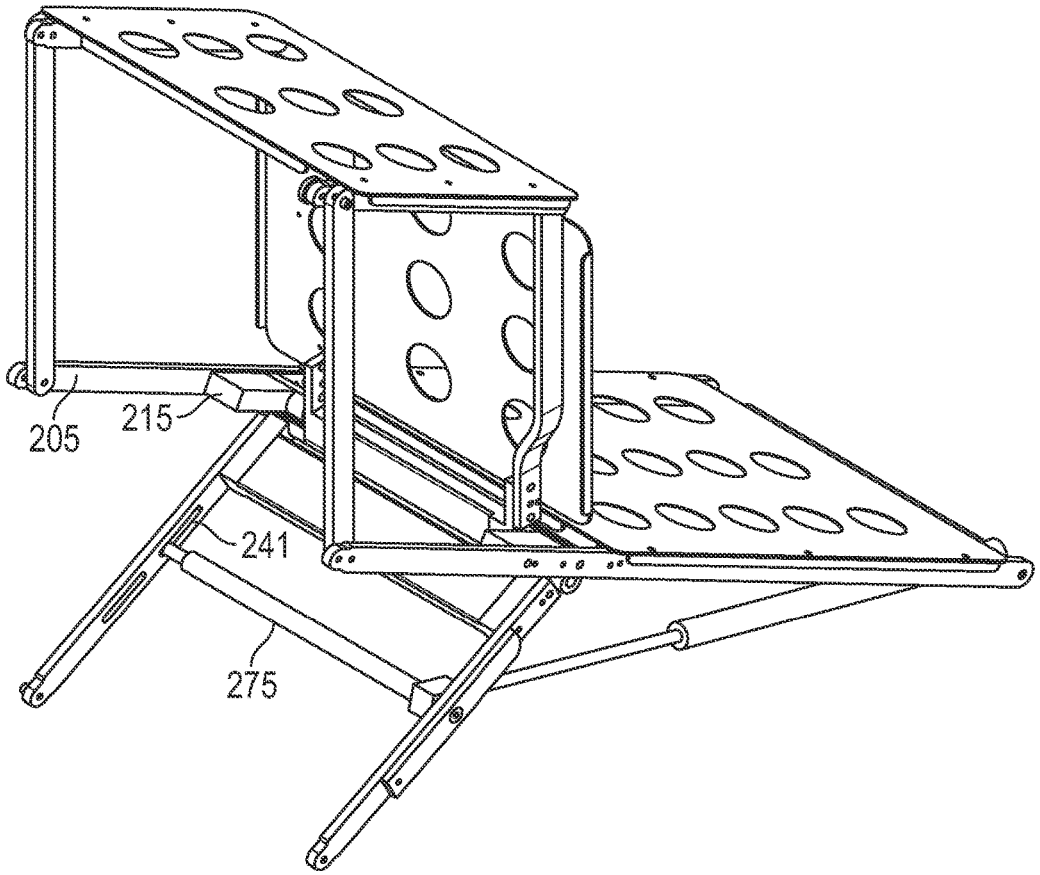
FIG. 39 is a perspective view of a lift chair in a near expanded position

FIG. 39 depicts a bottom and side perspective view of a disclosed lift is a seated position.

Figure 40:
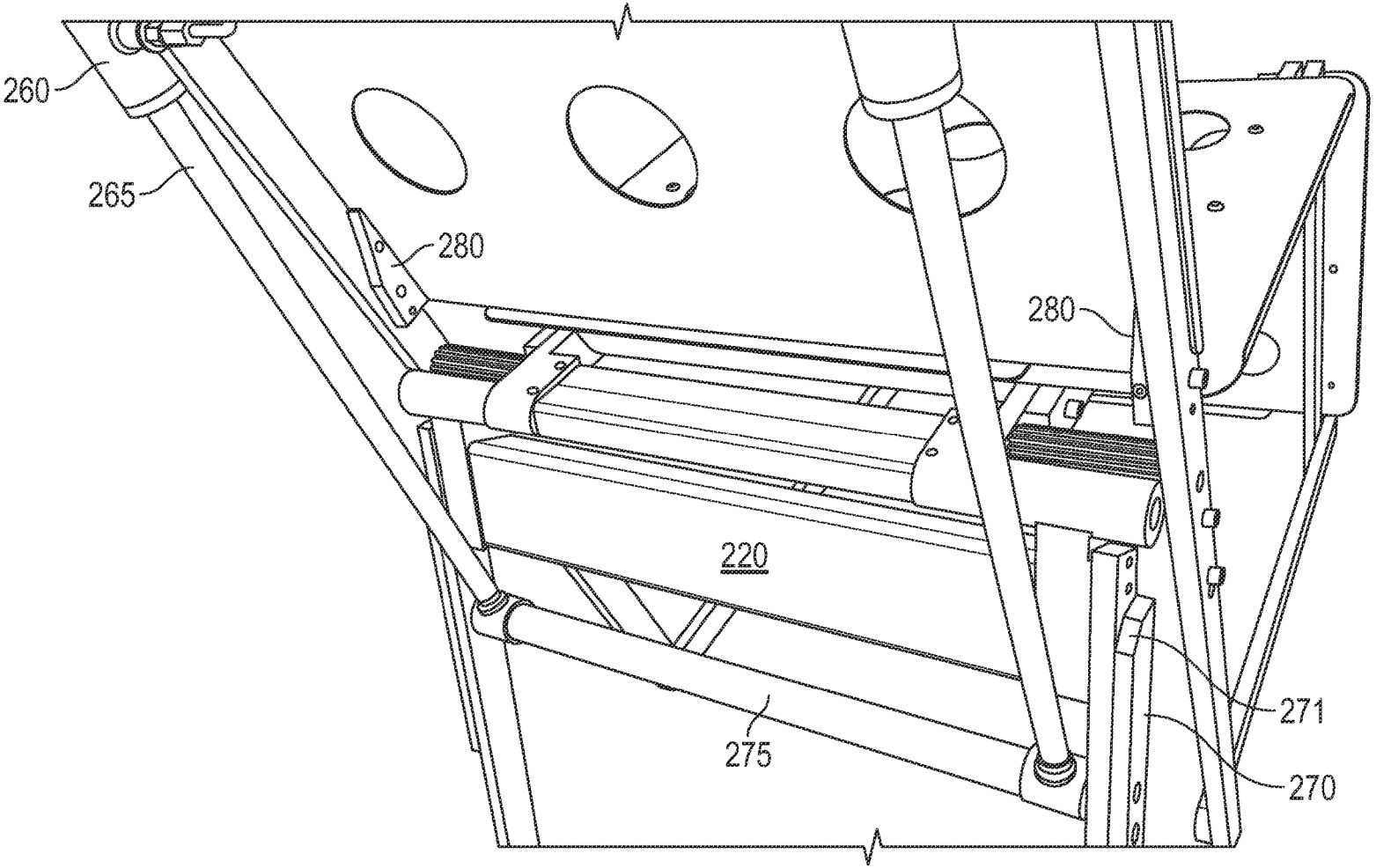
FIG. 40 is a perspective view of a lift chair

FIG. 40 depicts a rear and side perspective view of a disclosed lift.

Figure 41:
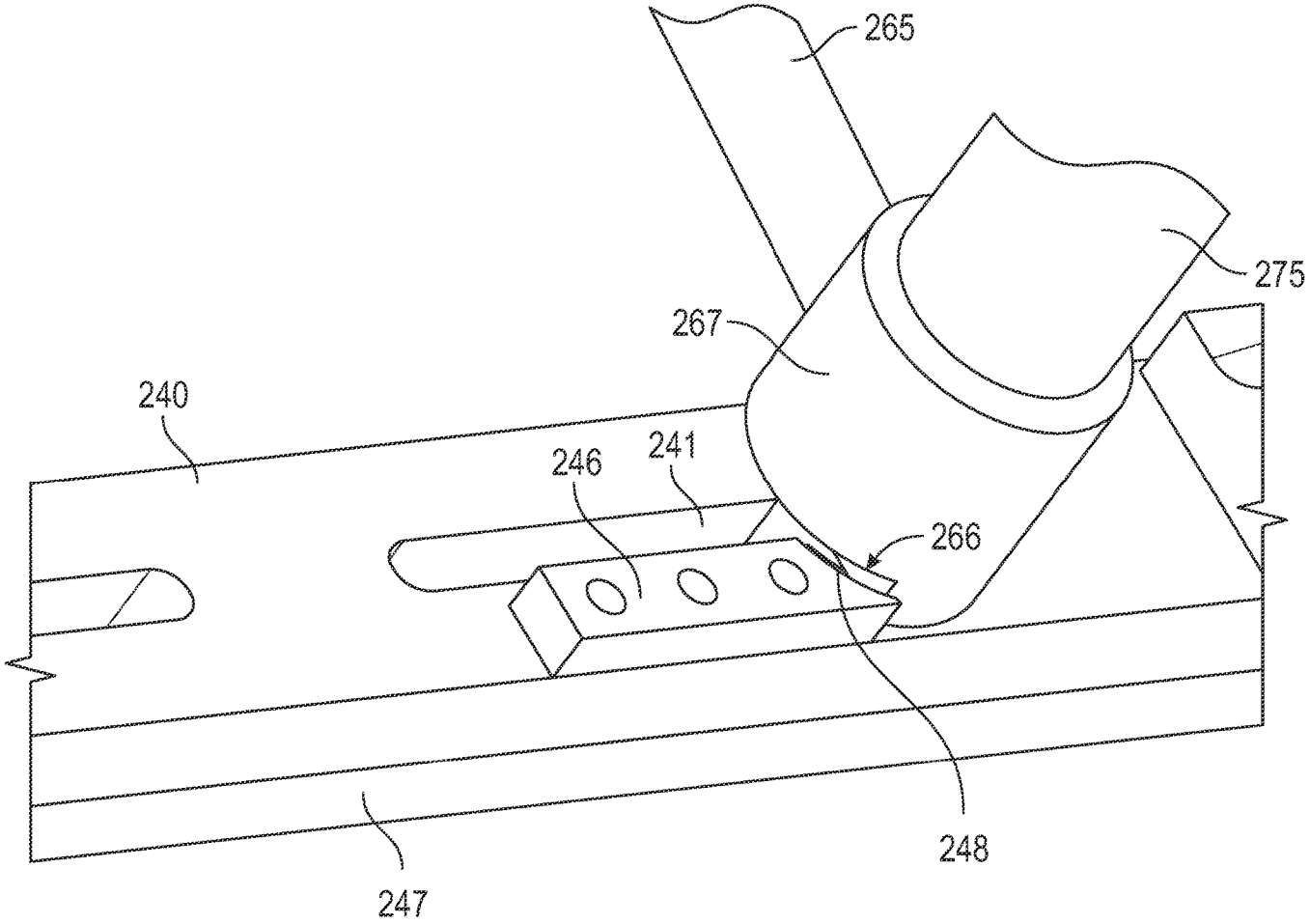
FIG. 41 is a perspective view of a wheelie bar having a latch

FIG. 41 depicts a perspective view of a wheelie bar 240 having a latch 246 and starting wedge 246. A cylinder clevis 267 may have a notch 266 or extra void space to comport with a curved edge 248 of the latch 246. A clevis may be of any form, including a cylinder or square.

In general, in one mode of operation, a disclosed lift chair begins to rise as the starting wedge is driven forward by the cross bar 275 or cylinder. In one embodiment, there is no interference between the latch 246 and the cylinder clevis 267 due to an extra notch 266 in the clevis. When the starting wedge 247 comes to the end of its travel the chair continues to rise with the cylinder or cross bar 275 pushing the wheelie bar 240. When the cylinder and wheelie bar pass through perpendicular the starting wedge is prevented from moving by the latch 246 contacting the full diameter of the cylinder clevis.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

What is claimed is:

1. A lift comprising:

a) a back strut attached to a back gear;

b) a hinge plate pivotally attached to the back gear;

c) a wheelie gear pivotally attached to the hinge plate; and d) a wheelie bar attached to the wheelie gear.

2. The lift of claim 1 wherein:

a) the wheelie bar comprises a longitudinal void; and b) a lower cross bar comprises a first end and the first end is attached through the longitudinal void of the wheelie bar.

3. The lift of claim 2 wherein:

a) an upper cross bar is attached to a back end of the back strut.

4. The lift of claim 3 wherein:

a) a wedge bar is connected to the first end of the lower cross bar.

5. The lift of claim 4 wherein:

a) a wedge is attached to the back strut; and b) the wedge bar comprising a cambered edge.

6. The lift of claim 5 wherein:

a) a seat strut is attached to the hinge plate.

7. The lift of claim 6 wherein:

a) a front strut is pivotally attached to the seat strut and the front strut is pivotally attached to a bottom strut and the bottom strut is pivotally attached to a bottom end of the back strut.

8. The lift of claim 7 wherein:

a) a back plate is attached to the back strut;

b) a seat plate is attached to the seat strut; and c) a leg plate is attached to the front strut.

9. The lift of claim 8 wherein:

a) an expansion apparatus attached to the upper cross bar and lower cross bar.

10. The lift of claim 9 wherein the expansion apparatus comprises a piston and cylinder.

11. The lift of claim 10 further comprising:

a) the top cross bar attached to a second back strut;

b) the second back strut attached to a second wedge;

c) the second back strut attached to a second back gear, with the second back gear pivotally attached to the hinge plate;

d) the second back strut pivotally attached to a second bottom strut and the second bottom strut pivotally attached to a second front strut and the second front strut pivotally attached to a second seat strut, with the second seat strut attached to the hinge plate.

12. The lift of claim 11 further comprising:

a) The first and second wedge bars each comprising an indent area containing a washer, with the washer retained by a nipple end of the cross bar.

13. A lift comprising:

a) a first and second back strut, with each back strut comprising a bottom end and a back end and each back strut attached to a wedge;

b) a top cross bar attached to the back end of each back strut;

c) a first and second back gear with a back gear attached to each back strut, with each back gear pivotally attached to a hinge plate;

d) the hinge plate pivotally attached to a wheelie gear;

e) the wheelie gear attached to a first and second wheelie bar;

f) each wheelie bar defining a longitudinal void;

g) a lower cross bar attached within each longitudinal void of each wheelie bar and the lower cross bar further attached to a first and second wedge bar with each wedge bar comprising a cambered edge;

h) a first and second seat strut attached to the hinge plate;

i) a first and second front strut pivotally attached to the two seat struts;

j) a first and second bottom strut pivotally attached to the two front struts and pivotally attached to a bottom end of the back struts.

14. The lift of claim 13 further comprising:

a) a back plate attached to the two back struts;

b) a seat plate attached to the two seat struts;

c) a leg plate attached to the two front struts.

15. The lift of claim 14 further comprising:

a) an expansion mechanism attached to the lower cross bar and upper cross bar.

16. The lift of claim 14 further comprising:

a) a piston and cylinder attached to the lower cross bar and to the upper cross bar.

17. The lift of claim 16 further comprising:

a) the wheelie gear further comprising a cross bar flanked by two side bars with each side bar comprising a pivot head with each pivot head comprising a plurality of gear teeth and with each pivot head defining a pivot void;

b) the first and second back gear each comprising a body attached to a pivot head and each pivot head defining a pivot void and each pivot head comprising a plurality of gear teeth; and c) the hinge plate comprising a horizontal bar attached to two side retainer brackets with each side retainer bracket defining a void comporting to the pivot void of the wheelie gear and a void comporting to the pivot void of the back gear.

18. The lift of claim 17 further comprising:

a) the two wedges further comprising an angled edge;

b) the two seat struts further comprising a seat plate support area connected to a curved section and the curved section connected to an attachment area;

c) the upper and lower cross bars further comprising a main longitudinal section flanked by two retention areas with each retention area attached to a washer nipple, with each washer nipple attached to a washer, with each washer retained within one of the wedge bars.

* * * * *